US006200744B1

(12) United States Patent
Sasaki et al.

(10) Patent No.: US 6,200,744 B1
(45) Date of Patent: Mar. 13, 2001

(54) SILVER HALIDE PHOTOGRAPHIC LIGHT-SENSITIVE MATERIAL

(75) Inventors: Hirotomo Sasaki; Hiroshi Takeuchi, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/502,076

(22) Filed: Feb. 10, 2000

(30) Foreign Application Priority Data

Feb. 10, 1999 (JP) ..... 11-032304

(51) Int. Cl.[7] ..... G03C 1/08

(52) U.S. Cl. ..... 430/600; 430/604; 430/605

(58) Field of Search ..... 430/600, 604, 430/567, 569, 605

(56) References Cited

U.S. PATENT DOCUMENTS 5,614,360 3/1997 Harbison et al. .

FOREIGN PATENT DOCUMENTS

19816922 * 10/1999 (DE) .

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

Disclosed is a silver halide photographic light-sensitive material comprising at least one photosensitive silver halide emulsion layer on a support, and containing a Pd(II) complex represented by formula (I-1):

Formula (I-1)

where $Z_1$ represents an alkylene group, an arylene group, or a divalent heterocyclic group, Q represents an ion which neutralizes electric charge of the Pd complex, m represents an integer of from 0 to 4, $R_1$ represents a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group, each of $X_1$ and $X_2$ represents a hydrogen atom, an alkyl group, an aryl group, or a heterocyclic group, and each of $Y_1$ and $Y_2$ represents an organic or inorganic ligand wherein $Y_1$ and $Y_2$ may be combined to form a ring together with Pd.

6 Claims, No Drawings

SILVER HALIDE PHOTOGRAPHIC LIGHT-SENSITIVE MATERIAL

BACKGROUND OF THE INVENTION

The present invention relates to a silver halide photographic light-sensitive material and, more particularly, to a silver halide photographic light-sensitive material which varies photographic properties little and produces fog little after storage.

Since silver halide photographic light-sensitive materials are demanded to have high sensitivity, the importance of high-aspect-ratio emulsions is increasing. As the sensitivity is increasing, variations in photographic properties caused by storage after the manufacture of photosensitive materials tend to increase. This variation in photographic properties is desired to be suppressed, particularly the technique of suppressing an increase in fog is needed. Meanwhile, variations in photographic properties in the running process are also desired to be little. That is, it is demanded to suppress both variations in photographic properties during storage and variations in photographic properties before and after the running process.

For the purpose of suppressing fog, the addition of palladium compounds such as a palladium complex of ethylenediamine is disclosed in U.S. Pat. Nos. 2,552,229 and 2,566,263 and Jpn. Pat. Appln. KOKAI Publication No. (hereinafter referred to as JP-A-)5-333480. In effect, the method has the effect of suppressing increases in fog during storage.

JP-A-8-234341 (U.S. Pat. No. 5,614,360) has disclosed that when palladium compounds of ethylenediamine are used, the viscosity does not rise even at high gelatin density. However, when photosensitive materials are stored under high-temperature, high-humidity tropical conditions, the effect of suppressing fog is unsatisfactory, so further improvements are being desired (U.S. Pat. No. 2,552,229 shows data on this storage fog under tropical conditions).

The present inventors made extensive studies and have found that variations in photographic properties caused by the running process increase when a Pd complex described in aforesaid JP-A-8-234341 (U.S. Pat. No. 5,614,360) is used.

On the other hand, no conventional technique concerning a Pd ligand has been known which uses, for the aforementioned purpose, a complex to which nitrogen of a carbamoyl group coordinates.

As described above, as the sensitivity of an emulsion rises, fog produced during storage increases. Hence, if the sensitivity is raised by increasing the aspect ratio, photographic properties, such as fog produced during storage, largely change with time. As described above, no conventional technique has been known which prevents changes in photographic properties during storage and reduces variations in photographic properties in the running process, by using a Pd(II) complex to which nitrogen of a carbamoyl group coordinates.

BRIEF SUMMARY OF THE INVENTION

It is an object of the present invention to provide a means for improving the storage stability of a silver halide photographic light-sensitive material, particularly a means for suppressing an increase in fog during storage under high-temperature, high-humidity conditions. It is another object of the present invention to provide a silver halide photographic light-sensitive material which changes photographic properties little before and after the running of development.

The above objects have been achieved by (1) to (6) below.

(1) A silver halide photographic light-sensitive material comprising at least one photosensitive silver halide emulsion layer on a support, and containing a Pd(II) complex represented by formula (I-1):

Formula (I-1)

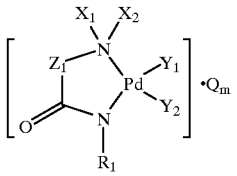

where $Z_1$ represents an alkylene group, an arylene group, or a divalent heterocyclic group, Q represents an ion which neutralizes electric charge of the Pd complex, m represents an integer of from 0 to 4, $R_1$ represents a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group, each of $X_1$ and $X_2$ represents a hydrogen atom, an alkyl group, an aryl group, or a heterocyclic group, and each of $Y_1$ and $Y_2$ represents an organic or inorganic ligand wherein $Y_1$ and $Y_2$ may be combined to form a ring together with Pd.

(2) The silver halide photographic light-sensitive material described in item (1) above, where the Pd(II) complex is represented by formula (I-2):

Formula (I-2)

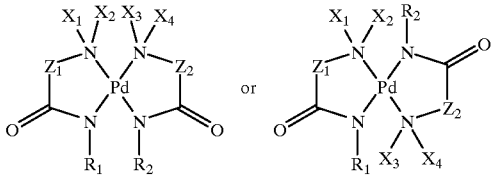

where each of $Z_1$ and $Z_2$ represents an alkylene group, an arylene group, or a divalent heterocyclic group, each of $R_1$ and $R_2$ represents a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group, and each of $X_1$, $X_2$, $X_3$, and $X_4$ represents a hydrogen atom, an alkyl group, an aryl group, or a heterocyclic group.

(3) The silver halide photographic light-sensitive material described in item (1) above, comprising at least one blue-sensitive emulsion layer, at least one green-sensitive layer, at least one red-sensitive layer, and at least one non-light-sensitive layer.

(4) The silver halide photographic light-sensitive material described in item (2) above, comprising at least one blue-sensitive emulsion layer, at least one green-sensitive layer, at least one red-sensitive layer, and at least one non-light-sensitive layer.

(5) The silver halide photographic light-sensitive material described in item (3) above, where 60% or more of a total projected area of silver halide grains contained in the photosensitive silver halide emulsion layer is occupied by tabular silver halide grains having an aspect ratio of 8 or more.

(6) The silver halide photographic light-sensitive material described in item (4) above, where 60% or more of a total projected area of silver halide grains contained in the photosensitive silver halide emulsion layer is occupied by tabular silver halide grains having an aspect ratio of 8 or more.

The present invention can improve the storage stability of a silver halide photosensitive material, particularly, can suppress an increase in fog during storage under high-temperature, high-humidity conditions, and can decrease a density change in an unexposed portion before and after the running process of development.

DETAILED DESCRIPTION OF THE INVENTION

The compound represented by formula (I-1) or (I-2) of the present invention has a structural characteristic feature that the carbamoyl group coordinates to Pd (II) at its N atom with its N-proton dissociated from the N atom. The N-proton of the carbamoyl group does not readily dissociate at low pH, but the N-protonation and the dissosiation of the N-proton (deprotonation) are in an equilibrium state in solution. Accordingly, the effect of the present invention can also be obtained even if the compound of the present invention is made into an acidic solution, in which the N atom of the carbamoyl group is protonated as noted above, and such acidic solution is used or added according to the present invention.

Compounds represented by formulas (I-1) and (I-2) of the present invention release a ligand when capturing cyan ion having adverse effect on storage stability. The present inventors, however, believe that the released ligand has no influence on the storage stability of an emulsion, since the released ligand protonates and loses its coordinating power over silver ion.

Compounds represented by formulas (I-1) and (I-2) will be described in detail below.

$Z_1$, $R_1$, $X_1$, and $X_2$ in formula (I-1) have the same meanings as $Z_1$, $R_1$, $X_1$, and $X_2$ in formula (I-2).

In formula (I-1), Q represents an ion which neutralizes electric charge of a Pd complex.

Examples of an anion are halogen ion, nitric acid ion, carbonic acid ion, hydrogencarbonate ion, sulfuric acid ion, sulfurous acid ion, cyano ion, cyanic acid ion, isocyanic acid ion, thiocyanic acid ion, boric acid ion, phosphonic acid ion, perchloric acid ion, organic carboxylic acid ion (e.g., formic acid ion, acetic acid ion, and oxalic acid ion), and organic sulfonic acid ion (e.g., methanesulfonic acid ion, benzenesulfonic acid ion, p-toluenesulfonic acid ion, and 2,6-naphthalenedisulfonic acid ion). Preferable examples are a halogen ion (chloro ion and bromo ion), nitric acid ion, sulfuric acid ions, sulfurous acid ion, cyanic acid ion, and perchloric acid ion.

Examples of a cation are alkaline metal ion (e.g., sodium ion, potassium ion, and lithium ion), alkaline-earth metal ion (e.g., potassium ion and magnesium ion), ammonium ion, and quaternary ammonium ion (e.g., tetramethylammonium ion and tetraethylammonium ion). Preferable examples are sodium ion and potassium ion.

m represents an integer of from 0 to 4, preferably of from 0 to 2.

In formula (I-1), $Y_1$ and $Y_2$ independently represent an organic or inorganic ligand. Examples of the inorganic ligand are halogen ion (e.g., chloro ion, bromo ion, and iodo ion), pseudo-halogen ion (e.g., thiocyanate ion and cyanate ion), ammonia, and carbonyl ligand. Examples of the organic ligand are amines (e.g., methyl amine and triethylamine), a nitrogen-containing heterocyclic compound (e.g., pyridine and imidazole), and organic carboxylic acid ion (e.g., acetate ion and oxalic acid ion). $Y_1$ and $Y_2$ can also bond to each other and coordinate to Pd(II) as a chelating ligand. One practical example is that amino acids (e.g., glycine and alanine) coordinate to Pd via a nitrogen atom and an oxygen atom. Formula (I-2) corresponds to this case.

$Z_1$, $Z_2$, $R_1$, $R_2$, $X_1$, $X_2$, $X_3$, and $X_4$ in formula (I-2) will be described below.

In formula (I-2), $Z_1$ and $Z_2$ independently represent an alkylene group (e.g., methylene, ethylene, propylene, cyclopentylene, or cyclohexylene), an arylene group (e.g., phenylene or naphthalene), or a divalent heterocyclic group (e.g., pyridine, imidazole, quinoline, pyrimidine, thiazole, thiophene, furan, morpholine, piperazine, or piperidine as a heterocyclic ring).

In formula (I-2), $R_1$ and $R_2$ independently represent a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group. An alkyl group represented by $R_1$ and $R_2$ is preferably a $C_1$–$C_{30}$ alkyl group, and particularly preferably, a $C_1$–$C_{10}$ straight, branched, or cyclic alkyl group. Examples are methyl, ethyl, propyl, and cyclopropyl. In this specification, the number of carbon atoms is so defined that if an alkyl group represented by $R_1$ and $R_2$ contains a substituent group (to be described later), the number of carbon atoms of this substituent group is also included. This holds for other groups. An aryl group represented by $R_1$ and $R_2$ is preferably a $C_6$–$C_{30}$ aryl group, and particularly preferably, a $C_6$–$C_{12}$ monocyclic, or condensed-ring, aryl group. Examples are phenyl and naphthyl. A heterocyclic group represented by $R_1$ and $R_2$ is a 3- to 10-membered saturated or unsaturated heterocyclic group containing at least one of a nitrogen atom, oxygen atom, and sulfur atom. This group can be a monocyclic ring or can form a condensed ring with another ring. A heterocyclic ring is preferably a 5- or 6-membered aromatic heterocyclic ring. Examples are 2-pyridyl, 2-imidazolyl, 2-quinolyl, 2-benzimidazolyl, 4-pyrimidyl, 3-pyrazolyl, 2-isoquinolyl, 2-thiazolyl, 3-thienyl, 2-furyl, and 2-benzothioazolyl.

An acyl group, alkoxycarbonyl group, aryloxycarbonyl group, carbamoyl group, alkylsulfonyl group, and arylsulfonyl group represented by $R_1$ and $R_2$ preferably have 1 to 20 carbon atoms. Examples are acetyl, benzoyl, formyl, methoxycarbonyl, ethoxycarbonyl, phenoxycarbonyl, mesyl, and tosyl.

In formula (I-2), a hydrogen atom, alkyl group, aryl group, and heterocyclic group independently represented by $X_1$, $X_2$, $X_3$, and $X_4$ have the same meanings as a hydrogen atom, alkyl group, aryl group, and heterocyclic group represented by $R_1$ and $R_2$.

In formula (I-2), each group represented by $R_1$, $R_2$, $X_1$, $X_2$, $X_3$, $X_4$, $Z_1$, and $Z_2$ can be substituted. Examples of the substituent are as follows.

A halogen atom (fluorine, chlorine, bromine, and iodine), a cyano group, a nitro group, an ammonio group (e.g., a trimethylammonio group), a phosphonio group, a sulfo group (including salt), a sulfino group (including salt), a carboxy group (including salt), a phosphono group (including salt), a hydroxy group, a mercapto group, a hydrazino group, an alkyl group (e.g., methyl, ethyl, n-propyl, isopropyl, t-butyl, n-octyl, cyclopentyl, and cyclohexyl), an alkenyl group (e.g., allyl, 2-butenyl, and 3-pentenyl), an alkinyl group (e.g., propargyl and 3-pentinyl), an aralkyl group (e.g., benzyl and phenethyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, and butyloxy), an aryloxy group (e.g., phenoxy and 2-naphthyloxy), an alkylthio group (e.g., methylthio and ethylthio), an arylthio group (e.g., phenylthio), an amino group (e.g., a nonsubstituted amino group, methylamino, dimethylamino, ethylamino, and anilino), an acyl group (e.g., acetyl, benzoyl, formyl, and pivaloyl), an alkoxycarbonyl group (e.g., methoxycarbonyl and ethoxycarbonyl), an aryloxycarbonyl group (e.g., phenoxycarbonyl), a carbamoyl group (e.g., a nonsubstituted carbamoyl group, N,N-dimethylcarbamoyl, N-ethylcarbamoyl, and N-phenylcarbamoyl), an acyloxy group (e.g., acetoxy and benzoyloxy), an acylamino group (e.g., acetylamino and benzoylamino), an alkoxycarbonylamino group (e.g., methoxycarbonylamino), an aryloxycarbonylamino group (e.g., phenoxycarbonylamino), an ureido group (e.g., a nonsubstituted ureido group, N-methylureido, and N-phenylureido), an alkylsulfonylamino group (e.g., methylsulfonylamino), an arylsulfonylamino group (e.g., phenylsulfonylamino), an alkylsulfonyloxy group (e.g., methylsulfonyloxy), an arylsulfonyloxy group (e.g., phenylsulfonyloxy), an alkylsulfonyl group (e.g., mesyl), an arylsulfonyl group (e.g., tosyl), an alkoxysulfonyl group (e.g., methoxysulfonyl), an aryloxysulfonyl group (e.g., phenoxysulfonyl), a sulfamoyl group (e.g., a nonsubstituted sulfamoyl group, N-methylsulfamoyl, N,N-dimethylsulfamoyl, and N-phenylsulfamoyl), an alkylsulfinyl group (e.g., methylsulfinyl), an arylsulfinyl group (e.g., phenylsulfinyl), an alkoxysulfinyl group (e.g., methoxysulfinyl), an aryloxysulfinyl group (e.g., phenoxysulfinyl), and a phosphoric acid amide group (e.g., N,N-diethyl phosphoric acid amide). These groups can be further substituted. If two or more substituent groups exist, they can be the same or different.

In formula (I-2), the two ligands can be the same or different. $X_1$ and $Z_1$ and/or $X_4$ and $Z_2$ can connect with each other to form a ring. Furthermore, $X_1$ and $X_3$, or $R_1$ and $R_2$, can connect with each other to form a compound which coordinates to palladium ion by one molecule.

In a compound represented by formula (I-2), the two ligands can take either a trans- or cis-structure.

A compound preferably used in the present invention is a compound represented by formula (I-2).

In formula (I-2), it is preferable that each of $Z_1$ and $Z_2$ represent an alkylene group, each of $R_1$ and $R_2$ represent a hydrogen atom, an alkyl group, an acyl group, a carbamoyl group, an alkylsulfonyl group, or an arylsulfonyl group, and each of $X_1$, $X_2$, $X_3$, and $X_4$ represent a hydrogen atom or an alkyl group.

In formula (I-2), it is more preferable that each of $Z_1$ and $Z_2$ represent an alkylene group, each of $R_1$ and $R_2$ represent a hydrogen atom or an alkyl group, and each of $X_1$, $X_2$, $X_3$, and $X_4$ represent a hydrogen atom or an alkyl group.

In formula (I-2), it is most preferable that each of $Z_1$ and $Z_2$ represent an methylene group, each of $R_1$ and $R_2$ represent a hydrogen atom or a $C_1$–$C_6$ alkyl group substituted with a hydrophilic group (e.g., a sulfo group, a carboxy group, a hydroxy group, an amino group, an ammonium group, a carbamoyl group, or a sulfamoyl group), and each of $X_1$, $X_2$, $X_3$, and $X_4$ represent a hydrogen atom or a 1- to 6-carbon alkyl group substituted with a hydrophilic group (e.g., a sulfo group, a carboxy group, a hydroxy group, an amino group, an ammonium group, a carbamoyl group, or a sulfamoyl group).

Practical examples of a compound represented by formula (I-1) are presented below in (I)-1 to (I)-23, but compounds used in the present invention are not limited to these examples. In the following practical examples, compounds represented by formula (I-2) are compounds (I)-1 to (I)-16 and (I)-20 to (I)-23).

(I)-1

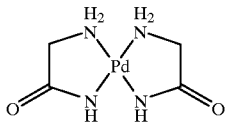

(I)-2

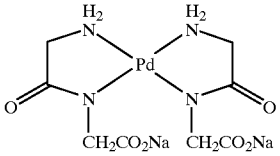

(I)-3

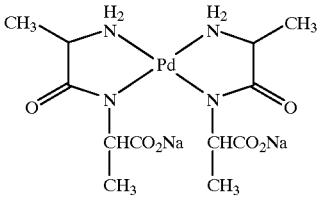

(I)-4

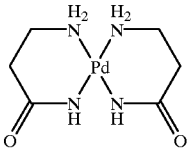

(I)-5

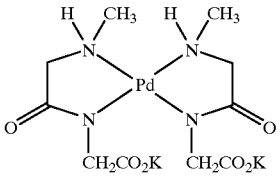

(I)-6

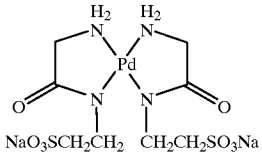

(I)-7

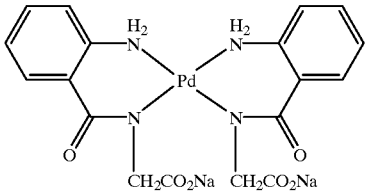

-continued
(I)-8
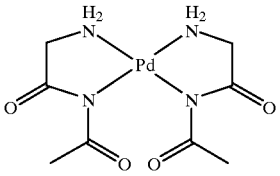
(I)-9
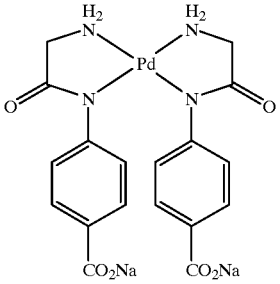
(I)-10
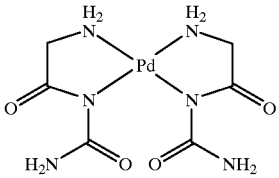
(I)-11
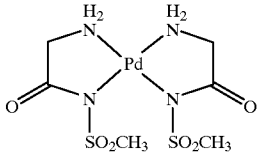
(I)-12
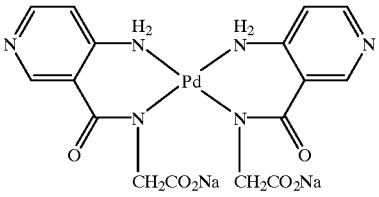
(I)-13
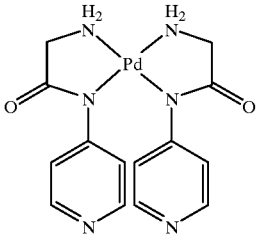
(I)-14
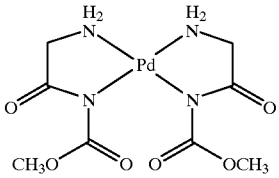
-continued
(I)-15
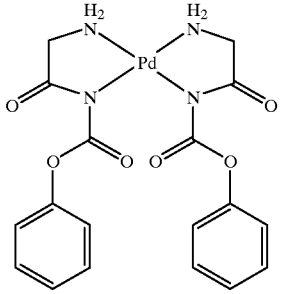
(I)-16
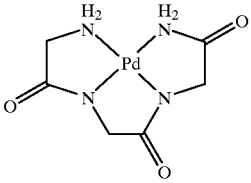
(I)-17
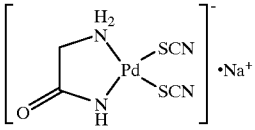
(I)-18
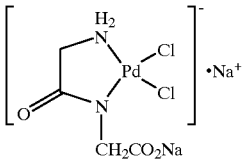
(I)-19
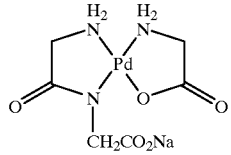
(I)-20
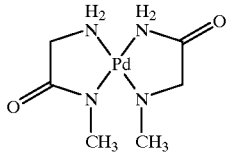
(I)-21
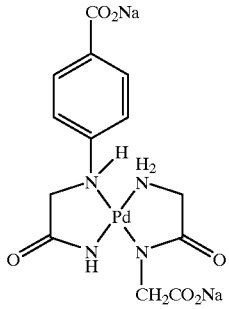

-continued (I)-22

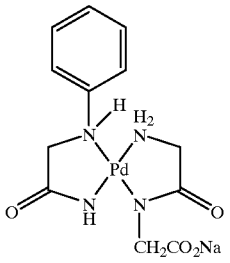

(I)-23

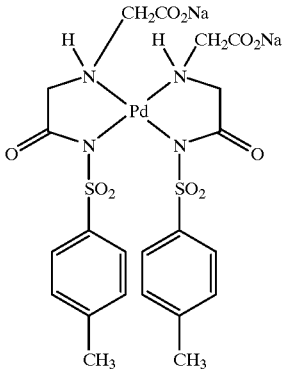

Ligands in formulas (I-1) and (I-2) are readily available as chemicals on the market or as compounds synthesized from these chemicals on the market by known methods.

Palladium compounds represented by formulas (I-1) and (I-2) can be synthesized from the corresponding ligands and organic or inorganic palladium compounds by using known methods. These synthesizing methods are described in, e.g., J. Inorg. Nucl. Chem., Vol. 41, p. 429 (1979), Inorg. Chim. Acta, Vol. 7, p. 88 (1973), Acta Crystallogr., Sect. B, Vol. 29, p. 762 (1973), Inorganic Chemistry, Vol. 7, p. 1,447 (1968), Journal of Inorganic Chemistry, Vol. 8, p. 304 (1963), and Journal of Inorganic Chemistry, Vol. 23, p. 561 (1978), the disclosures of which are herein incorporated by reference. The simplest method is to dissolve a Pd(II) compound presented below and the corresponding ligand in an appropriate solvent such as water and alcohol and add an alkaline aqueous solution where necessary. This solution can be added to a silver halide photosensitive material of the present invention either directly or after being isolated as a Pd complex.

Palladium compounds used in the synthesis of compounds represented by formulas (I-1) and (I-2) are described in detail in Gmelin Handbook TEIL65 (1942) and Gmelin Handbook Supplement vol. B2 (1989), the disclosures of which are herein incorporated by reference. These compounds are available on the market and can also be synthesized.

Practical examples of useful palladium compounds are palladium(II) chloride, palladium(II) bromide, palladium(II) hydroxide, palladium(II) sulfate, palladium(II) thiocyanate, tetrachloropalladium(II) acid salt (sodium salt, potassium salt, and ammonium salt), tetrabromopalladium(II) acid salt, hexabromopalladium(IV) acid salt, bis(salicylate)palladium (II) acid salt, tetraamminepalladium(II) salt, dichlorodiaminepalladium(II), dibromodiaminepalladium (II), and oxalatediaminepalladium(II).

In the present invention, methods commonly used in adding additives to photographic light-sensitive materials are used to add compounds represented by formulas (I-1) and (I-2) to silver halide photosensitive materials. For example, a water-soluble compound can be added as an aqueous solution of proper concentration. A compound insoluble or sparingly soluble in water can be dissolved in an appropriate organic solvent miscible with water, e.g., a solvent which is alcohols, glycols, ketones, esters, or amides and has no adverse effects on photographic properties, and can be added as a solution. Also, as described above, compounds represented by formulas (I-1) and (I-2) can be synthesized and isolated by the methods described in the references cited above. Alternatively, these compounds can be added to silver halide photosensitive materials in the form of solution mixtures of palladium compounds and ligands without being isolated.

In the present invention, a solution of a palladium compound can be added to any one or more of the layers constituting the photographic light-sensitive material, i.e., can be added to photosensitive emulsion layers, interlayers, antihalation layers, and surface protective layers. Furthermore, a solution of a palladium compound of the present invention can be formed as another layer together with a binder. Preferably, a palladium compound solution is added to interlayers, antihalation layers, and surface protective layers. When a palladium compound solution is to be added to these layers, the solution is added to coating solutions of these layers at any arbitrary timing from preparation of the coating solutions to immediately before coating. When a palladium compound solution is to be added to photosensitive emulsion layers, the solution can be added immediately after grain formation of silver halide emulsions. However, the solution is preferably added after chemical sensitization.

As compounds represented by formulas (I-1) and (I-2), it is possible to add only one type of compound or two or more types of compounds.

In the present invention, the addition amount of a palladium compound is $1\times10^{-7}$ to $1\times10^{-3}$ mol, preferably, $1\times10^{-6}$ to $1\times10^{-4}$ mol, as a molar addition amount of Pd, per $m^2$ of a photosensitive material.

A photosensitive material of the present invention need only has at least one light-sensitive layer on a support. A typical example is a silver halide photographic light-sensitive material having, on a support, at least one unit light-sensitive layer consisting of a plurality of silver halide emulsion layers sensitive to essentially the same color but different in sensitivity. This light-sensitive layer is a unit light-sensitive layer sensitive to one of blue light, green light, and red light. In a multilayered silver halide color photosensitive material, unit light-sensitive layers are generally arranged in the order of red-, green-, and blue-sensitive layers from a support. However, according to the intended use, this order of arrangement can be reversed, or light-sensitive layers sensitive to the same color can sandwich another light-sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE (German Patent) 1,121,470 or GB (British Patent) 923,045, the disclosures of which are herein incorporated by reference, high- and low-speed emulsion layers are preferably arranged such that the sensitivity is sequentially decreased toward a support. Also, as described in JP-A-57-112751, JP-A-62-200350, JP-A-62-

206541, and JP-A-62-206543, the disclosures of which are herein incorporated by reference, layers can be arranged such that a low-speed emulsion layer is formed apart from a support and a high-speed emulsion layer is formed close to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in Jpn. Pat. Appln. KOKOKU Publication No. (hereinafter referred to as JP-B-)55-34932, the disclosure of which is herein incorporated by reference, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, the disclosure of which is herein incorporated by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When a layer structure is thus constituted by three layers having different sensitivities, these layers can be arranged, in a layer sensitive to one color, in the order of medium-speed emulsion layer/high-speed emulsion layer/low-speed emulsion layer from the farthest side from a support as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

When a silver halide photographic light-sensitive material of the present invention includes, on a support, at least one blue-sensitive silver halide emulsion layer containing a yellow coupler, at least one green-sensitive silver halide emulsion layer containing a magenta coupler, at least one red-sensitive silver halide emulsion layer containing a cyan coupler, and at least one non-light-sensitive layer, and has a specific sensitivity of 300 or more, spectral sensitivity $S_R(580)$ of the red-sensitive silver halide emulsion layer at 580 nm preferably has the following relationship with spectral sensitivity $S_R(\max)$ at the maximum sensitivity wavelength of that layer.

$$0.6 \leqq S_R(\max) - S_R(580) \leqq 0.9$$

Also, the weight-average wavelength ($\lambda_{-R}$) of the spectral sensitivity distribution of the interlayer effect, which the red-sensitive silver halide emulsion layer (if a plurality of layers exist, all of these layers) is given from other layers within the range of 500 to 600 nm, is preferably 500 nm$<\lambda_{-R} \leqq 560$ nm. The weight-average wavelength ($\lambda_G$) of the spectral sensitivity distribution of the green-sensitive silver halide emulsion layer (if a plurality of layers exist, all of these layers) is preferably 520 nm$<\lambda_G \leqq 580$ nm. Additionally, it is preferable that $\lambda_G - \lambda_{-R} \leqq 5$ nm.

As sensitizing dyes and solid disperse dyes used herein, those described in Japanese Patent Application No. 10-111196, the disclosure of which is herein incorporated by reference can be used. The specific sensitivity and the weight-average wavelength of the spectral sensitivity distribution of the interlayer effect which the red-sensitive silver halide emulsion layer is given from other layers can be calculated by methods described in Japanese Patent Application No. 10-111196.

In a silver halide photographic light-sensitive material of the present invention, spectral sensitivities $S_R(580)$ and $S_G(580)$ of a red-sensitive layer and a green-sensitive layer preferably satisfy the following ranges at the same time. $S_G(580)$ and $S_R(580)$ are defined by the logarithmic values of the reciprocals of exposure amounts necessary to obtain a density of minimum density plus 1.0 of magenta color generation and cyan color generation, respectively, at the respective wavelengths. $S_G(\max)$ and $S_R(\max)$ indicate the sensitivities of a green-sensitive layer and a red-sensitive layer, respectively, at the maximum sensitivity wavelength. The spectral sensitivity preferably remains unchanged from an underexposed portion to an overexposed portion.

$$0.6 \leqq S_R(\max) - S_R(580) \leqq 0.9$$

$$0.6 \leqq S_G(\max) - S_G(580) \leqq 1.1$$

The wavelength at which the sensitivity of a red-sensitive layer is a maximum is 610 to 640 nm, preferably, 620 to 635 nm. Spectral sensitivity $S_R(650)$ of a red-sensitive layer at 650 nm desirably has the following relationship.

$$S_R(650) \leqq S_R(\max) - 0.7$$

The definition of the spectral sensitivity is the same as above.

The wavelength at which the sensitivity of a green-sensitive layer is a maximum is 520 to 580 nm, preferably, 540 to 565 nm. Spectral sensitivity $S_G(525)$ of a green-sensitive layer at 525 nm desirably has the following relationship.

$$0.1 \leqq S_G(\max) - S_G(525) \leqq 0.3$$

As a means for improving the color reproduction, the use of an interlayer inhibiting effect is preferable. It is particularly preferable that the weight-average wavelength ($\lambda_G$) of the spectral sensitivity distribution of a green-sensitive silver halide emulsion layer be 520 nm$<\lambda_G \leqq 580$ nm, that the weight-average wavelength ($\lambda_{-R}$) of the spectral sensitivity distribution of the interlayer effect, which a red-sensitive silver halide emulsion layer is given from other silver halide emulsion layers within the range of 500 to 600 nm, be 500 nm$<\lambda_{-R} \leqq 560$ nm, and that $\lambda_G - \lambda_{-R}$ be 5 nm or more, preferably, 10 nm or more.

To obtain the interlayer effect to a red-sensitive layer as described above in a specific wavelength region, it is preferable to separately form an interlayer effect donor layer containing silver halide grains spectrally photosensitive material to a predetermined degree. To realize the spectral sensitivity of the present invention, the weight-average wavelength of this interlayer effect donor layer is set between 510 and 540 nm.

The weight-average wavelength $\lambda_{-R}$ of the wave-length distribution of the magnitude of the interlayer effect, which a red-sensitive silver halide emulsion layer is given from other silver halide emulsion layers within the range of 500 to 600 nm, can be calculated by a method described in Japanese Patent Application No. 10-111196. When $\lambda_{-B}$ is calculated following the same procedure as for $\lambda_{-R}$, the interlayer effect given by the interlayer effect donor layer must satisfy the condition (equation (2)) described in Japanese Patent Application No. 10-111196.

As a material for imparting the interlayer effect, a compound which releases a development inhibitor or its precursor by reacting with the oxidized form of a developing agent, which is produced by development, is used. Examples of the compound are a DIR (development inhibitor releasing) coupler, DIR-hydroquinone, and a coupler which releases DIR-hydroquinone or its precursor. For a development inhibitor having high diffusivity, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as that of a layer which undergoes the influence of the undesired development inhibiting effect). Generation of magenta is preferable to obtain the spectral sensitivity of the present invention.

The size and the shape of silver halide grains to be used in the layer having the interlayer effect on red-sensitive layers are not particularly restricted. It is, however, favorable to use so-called tabular grains having a high aspect ratio, a monodisperse emulsion which is uniform in grain size, or silver bromoiodide grains having a layered structure of iodide. In addition, to enlarge the exposure latitude, it is preferable to mix two or more types of emulsions of different grain sizes.

Although the donor layer which donates the interlayer effect to a red-sensitive layer can be formed in any position on a support, it is preferable to form this layer closer to the support than a blue-sensitive layer and farther from the support than a green-sensitive layer. It is more preferable that the donor layer be located closer to the support than a yellow filter layer.

It is further preferable that the donor layer which donates the interlayer effect to a red-sensitive layer be located closer to a support than a green-sensitive layer and farther from the support than the red-sensitive layer. It is most preferable that the donor layer be located adjacent to the side of a green-sensitive layer close to a support. "Adjacent" means that there is no interlayer or the like in between.

The layer which donates the interlayer effect to a red-sensitive layer can consist of a plurality of layers. In that case, these layers can be either adjacent to or separated from each other.

In the present invention, tabular silver halide grains (to be also referred to as tabular grains hereinafter) having an aspect ratio of 3 or more can also be used. The aspect ratio means the ratio of the diameter of a silver halide grain to its thickness. That is, the aspect ratio is a value obtained by dividing the diameters of individual silver halide grains by their thicknesses. Assume that the diameter of a silver halide grain means the diameter of a circle having an area equal to the projected area of the grain when the grain is observed with a microscope electron microscope. Accordingly, when the aspect ratio is 8 or more, this means that the diameter of this circle is 8 times or more as large as the thickness of the grain. In the present invention, in at least one photosensitive silver halide emulsion layer constituting a color photosensitive material 60% or more of the projected area of silver halide grains are preferably occupied by grains having an aspect ratio of 8 or more. Such an emulsion is preferably used in a layer in contact with, or separated by one to five layers from, a layer to which a Pd compound used in the present invention is added.

In the present invention, an average aspect ratio is the average value of the aspect ratios of all tabular grains in an emulsion. Tabular grains are grains having an aspect ratio of 2 or more. The average aspect ratio of tabular grains used in a photosensitive material of the present invention is preferably 9 or more, more preferably, 12 or more, and most preferably, 16 to 50.

One example of an aspect ratio measurement method is to take a transmission electron micrograph by using a replica method and obtain the equivalent-circle diameter and the thickness of each grain. In this method, the thickness is calculated from the length of a shadow of replica.

An emulsion used in a photosensitive material of the present invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is herein incorporated by reference. A method of preparing this core/shell internal latent image type emulsion is described in JP-A-59-133542, the disclosure of which is herein incorporated by reference. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization before being used. Additives for use in these steps are described in RD Nos. 17643, 18716, and 307105, the disclosures of which are herein incorporated by reference, and they are summarized in a table to be presented later.

In a photosensitive material of the present invention, it is possible to mix, in a single layer, two or more types of emulsions different in at least one of characteristics of a sensitive silver halide emulsion, i.e., a grain size, grain size distribution, halogen composition, grain shape, and sensitivity.

It is also possible to preferably use surface-fogged silver halide grains described in U.S. Pat. No. 4,082,553, the disclosure of which is herein incorporated by reference, internally fogged silver halide grains described in U.S. Pat. No. 4,626,498 and JP-A-59-214852, the disclosures of which are herein incorporated by reference, and colloidal silver, in photosensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852, the disclosures of which are herein incorporated by reference. A silver halide which forms the internal core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The average grain size means the average value of the diameters of spherical grains having the same volume. The grain size can be measured by a Coulter counter. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, it is preferable to use a non-light-sensitive fine grain silver halide. The non-light-sensitive fine grain silver halide consists of silver halide fine grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably 0.02 to 0.2 $\mu$m.

The fine grain silver halide can be prepared following the same procedures as for a common sensitive silver halide. The surface of each silver halide grain need not be optically photosensitive material nor spectrally photosensitive material. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a photosensitive material of the present invention is preferably 8.0 g/m$^2$ or less.

Although the several different additives described above are used in a photosensitive material according to this technique, a variety of other additives can also be used in accordance with the intended use.

These additives are described in more detail in Research Disclosures Item 17643 (December, 1978), Item 18716 (November, 1979), and Item 308119 (December, 1989), the disclosures of which are herein incorporated by reference. The corresponding portions are summarized in a table below.

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column to page 649, right column | page 996, right column to page 998, right column |
| 4. Brighteners | page 24 | | page 998, right column |
| 5. Antifoggants and stabilizers | pages 24–25 | page 649, right column | page 998, right column to page 1,000, right column |
| 6. Light absorbent, filter dye, ultraviolet absorbents | pages 25–26 | page 649, right column to page 650, left column | page 1,003, left column to page 1,003, right column |
| 7. Stain preventing agents | page 25, right column | page 650, left to right columns | page 1,002, right column |
| 8. Dye image stabilizer | page 25 | | page 1,002, right column |
| 9. Hardening agents | page 26 | page 651, left column | page 1,004, right column to page 1,005, left column |
| 10. Binder | page 26 | page 651, left column | page 1,003, right column to page 1,004, right column |
| 11. Plasticizers, lubricants | page 27 | page 650, right column | page 1,006, left to right columns |
| 12. Coating aids, surface active agents | pages 26–27 | page 650, right column | page 1,005, left column to page 1,006, left column |
| 13. Antistatic agents | page 27 | page 650, right column | page 1,006, right column to to page 1,007, left column |
| 14. Matting agent | | | page 1,008, left column to page 1,009, left column |

Techniques such as a layer arrangement technique, silver halide emulsions, dye formation couplers, functional couplers such as DIR couplers, various additives, and development usable in emulsions of the present invention and photosensitive materials using the emulsions are described in European Patent No. 0565096A1 (laid open in Oct. 13, 1993) and the patents cited in it, the disclosures of which are herein incorporated by reference. The individual items and the corresponding portions are enumerated below.

1. Layer arrangements: page 61, lines 23–35, page 61, line 41—page 62, line 14
2. Interlayers: page 61, lines 36–40
3. Interlayer effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54—page 63, line 5
12. Physical ripening-chemical ripening of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Photographic additives: described in Research Disclosure (RD) Item 17643 (December, 1978), RD Item 18716 (November, 1979), and RD Item 307105 (November, 1989), the disclosures of which are herein incorporated by reference. The individual items and the corresponding portions are presented below.

| Additives | RD17643 | RD18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, |

-continued

| | Additives | RD17643 | RD18716 |
|---|---|---|---|
| | | | right column |
| 4. | Brighteners | page 24 | page 647, right column |
| 5. | Antifoggants and stabilizers | pages 24–25 | page 649, right column |
| 6. | Light absorbent, filter dye, ultra-violet absorbents | pages 25–26 | page 649, right column to page 650, left column |
| 7. | Stain preventing agents | page 25, right column | page 650, left to right columns |
| 8. | Dye image stabilizer | page 25 | page 650, left column |
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |
| 14. | Matting agent | | |

| Additives | RD307105 |
|---|---|
| 1. Chemical sensitizers | page 866 |
| 2. Sensitivity increasing agents | |
| 3. Spectral sensitizers, super sensitizers | pages 866–868 |
| 4. Brighteners | page 868 |
| 5. Antifoggants and stabilizers | pages 868–870 |
| 6. Light absorbent, filter dye, ultra-violet absorbents | page 873 |
| 7. Stain preventing agents | page 872 |
| 8. Dye image stabilizer | page 872 |
| 9. Hardening agents | pages 874–875 |
| 10. Binder | pages 873–874 |
| 11. Plasticizers, lubricants | page 876 |
| 12. Coating aids, surface active agents | pages 875–876 |
| 13. Antistatic agents | pages 876–877 |
| 14. Matting agent | pages 878–879 |
| 18. Formaldehyde scavengers: | page 64, lines 54–57 |
| 19. Mercapto-based antifoggants: | page 65, lines 1–2 |
| 20. Agents releasing, e.g., fogging agent: | page 65, lines 3–7 |
| 21. Dyes: | page 65, lines 7–10 |
| 22. General color couplers: | page 65, lines 11–13 |
| 23. Yellow, magenta, and cyan couplers: | page 65, lines 14–25 |
| 24. Polymer couplers: | page 65, lines 26–28 |
| 25. Diffusing dye forming couplers: | page 65, lines 29–31 |
| 26. Colored couplers: | page 65, lines 32–38 |
| 27. General functional couplers: | page 65, lines 39–44 |
| 28. Bleaching accelerator release couplers: | page 65, lines 45–48 |
| 29. Development accelerator release couplers: | page 65, lines 49–53 |
| 30. Other DIR couplers: | page 65, line 54–page 66, line 4 |
| 31. Coupler diffusing methods: | page 66, lines 5–28 |
| 32. Antiseptic and mildewproofing agents: | page 66, lines 29–33 |
| 33. Types of light-sensitive materials: | page 66, lines 34–36 |
| 34. Light-sensitive layer film thickness and swell speed: | page 66, line 40–page 67, line 1 |

-continued

| Additives | RD307105 |
|---|---|
| 35. Back layers: | page 67, lines 3–8 |
| 36. General development processing: | page 67, lines 9–11 |
| 37. Developers and developing agents: | page 67, lines 12–30 |
| 38. Developer additives: | page 67, lines 31–44 |
| 39. Reversal processing: | page 67, lines 45–56 |
| 40. Processing solution aperture ratio: | page 67, line 57–page 68, line 12 |
| 41. Development time | page 68, lines 13–15 |
| 42. Bleach-fix, bleaching, and fixing: | page 68, line 16–page 69, line 31 |
| 43. Automatic processor: | page 69, lines 32–40 |
| 44. Washing, rinsing, and stabilization: | page 69, line 41–page 70, line 18 |
| 45. Replenishment and reuse of processing solutions: | page 70, lines 19–23 |
| 46. Incorporation of developing agent into light-sensitive material: | page 70, lines 24–33 |
| 47. Development temperature: | page 70, lines 34–38 |
| 48. Application to film with lens: | page 70, lines 39–41 |

It is also possible to preferably use a bleaching solution described in European Patent No. 602600 which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and use organic acid such as acetic acid, succinic acid, or maleic acid as the stop solution. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

Preferable examples of color reversal film processing agents containing the above contents are an E-6 processing agent manufactured by Eastman Kodak Co. and a CR-56 processing agent manufactured by Fuji Photo Film Co., Ltd.

A magnetic recording layer preferably used in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is herein incorporated by reference. A ferromagnetic grain whose surface is coated with an inorganic or organic substance described in JP-A-4-259911 or JP-A-5-81652, the disclosures of which are herein incorporated by reference can also be used.

As a binder used in the magnetic grains, it is possible to use a thermoplastic resin described in JP-A-4-219569, the disclosure of which is herein incorporated by reference, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is herein incorporated by reference.

As a method of dispersing the magnetic substance in the binder, as described in JP-A-6-35092, the disclosure of which is herein incorporated by reference, a kneader, pin type mill, and annular mill are preferably used singly or together. Dispersants described in JP-A-5-088283, the disclosure of which is herein incorporated by reference and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 g/m$^2$, preferably 0.01 to 2 g/m$^2$, and more preferably 0.02 to 0.5 g/m$^2$. The transmitting yellow density of the magnetic recording layer is preferably 0.01 to 0.50, more preferably 0.03 to 0.20, and most preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in, e.g., JP-A-5-341436, the disclosure of which is herein incorporated by reference is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, and titanium dioxide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP466,130, the disclosures of which are herein incorporated by reference.

A polyester support preferably used in the present invention will be described below. Details of the polyester support and sensitive materials, processing, cartridges, and examples (to be described later) are described in Journal of Technical Disclosure No. 94-6023 (JIII; Mar. 15, 1994), the disclosure of which is herein incorporated by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is most preferable among other polymers. The average molecular weight ranges between about 5,000 and 200,000. The Tg of the polyester of the present invention is 50° C. or higher, preferably, 90° C. or higher.

To give the polyester support a resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hr, more preferably 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-S-triazine), epichlorohydrin resin, and active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably, $10^5$ Ω·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides.

The content in a photosensitive material is preferably 5 to 500 mg/$m^2$, and most preferably, 10 to 350 mg/$m^2$. The ratio of a conductive crystalline oxide or its composite oxide to the binder is preferably 1/300 to 100/1, and more preferably, 1/100 to 100/5.

A photosensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost layer of emulsion side or back layer. Polydimethylcyloxane or ester having a long-chain alkyl group is particularly preferable.

A photosensitive material of the present invention preferably contains a matting agent. This matting agent can be added to either the emulsion surface or back surface and is most preferably added to the outermost layer of emulsion side. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m) grains, polystyrene grains (0.25 $\mu$m), and colloidal silica grains (0.03 $\mu$m).

A film patrone used in the present invention will be described below. The principal material of the patrone used in the present invention can be a metal or synthetic plastic.

Preferable plastic materials are, e.g., polystyrene, polyethylene, polypropylene, and polyphenylether. The patrone of the present invention can also contain various antistatic agents. For this purpose, carbon black, metal oxide grains, nonion-, anion-, cation-, and betaine-based surfactants, or a polymer can be preferably used. These patrones subjected to the antistatic treatment are described in JP-A-1-312537 and JP-A-1-312538, the disclosures of which are herein incorporated by reference. It is particularly preferable that the resistance be $10^{12}$Ω or less at 25° C. and 25% RH. Commonly, plastic patrone are manufactured by using plastic into which carbon black or a pigment is incorporated in order to give a light-shielding property. The patrone size can be a presently available 135 size. To miniaturize cameras, it is effective to decrease the diameter of a 25-mm patrone of 135 size to 22 mm or less. The volume of a patrone case is 30 $cm^3$ or less, preferably, 25 $cm^3$ or less. The weight of plastic used in the patrone and the patrone case is preferably 5 to 15 g.

Furthermore, a patrone which feeds a film by rotating a spool can be used in the present invention. It is also possible to use a structure in which a film leader is housed in a patrone main body and fed through a port of the patrone to the outside by rotating a spool shaft in the film feed direction. These structures are disclosed in U.S. Pat. No. 4,834,306 and U.S. Pat. No. 5,226,613, the disclosures of which are herein incorporated by reference. Photographic films used in the present invention can be so-called raw films before being developed or developed photographic films. Also, raw and developed photographic films can be accommodated in the same new patrone or in different patrones.

A color photosensitive material of the present invention is also suitably used as a negative film for the advanced photo system (to be referred to as the APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as Fuji Film EPION Series (e.g., EPION 300Z). A color photosensitive material of the present invention is also suited as a film with lens such as Fuji Film FUJICOLOR UTSURUNDESU SUPER SLIM.

A photographed film is printed through the following steps in a miniature laboratory system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably Fuji Film SUPER FA8])

(6) Collation and shipment (the cartridge and the index print are collated by an ID number and shipped together with the prints)

As these systems, Fuji Film MINILABO CHAMPION SUPER FA-298, FA-278, FA-258, FA-238 and Fuji Film DIGITAL LABO SYSTEM FRONTIER are preferable.

Examples of a processor for MINILABO CHAMPION are FP922AL, FP562B, FP562B, AL, FP362B, and FP362B, AL, and recommended processing chemicals are FUJICOLOR JUST-IT CN-16L AND CN-16Q. Examples of a printer processor are PP3008AR, PP3008A, PP1828AR, PP1828A, PP1258AR, PP1258A, PP728AR, and PP728A, and recommended processing chemicals are FUJICOLOR JUST-IT CP-47L and CP40FAII. In FRONTIER SYSTEM, Scanner & Image Processor SP-1000 and Laser Printer & Paper Processor LP-1000P or Laser Pinter LP-1000W are used. A detacher used in the detaching step and a reattacher used in the reattaching step are preferably Fuji Film DT200 or DT100 and AT200 or AT100, respectively.

The APS can also be enjoyed by PHOTO JOY SYSTEM whose main component is Fuji Film Digital Image Workstation Aladdin 1000. For example, a developed APS cartridge film is directly loaded into Aladdin 1000, or image information of a negative film, positive film, or print is input to Aladdin 1000 by using 35-mm Film Scanner FE-550 or Flat Head Scanner PE-550. Obtained digital image data can be easily processed and edited. This data can be printed out by Digital Color Printer NC-550AL using a photo-fixing heat-sensitive color printing system or PICTOROGRAPHY 3000 using a laser exposure thermal development transfer system, or by existing laboratory equipment through a film recorder. Aladdin 1000 can also output digital information directly to a floppy disk or Zip disk or to an CD-R via a CD writer.

In a home, a user can enjoy photographs on a TV set simply by loading a developed APS cartridge film into Fuji Film Photo Player AP-1. Image information can also be continuously input to a personal computer at a high-speed by loading a developed APS cartridge film into Fuji Film Photo Scanner AS-1. Fuji Film Photo Vision FV-10 or FV-5 can be used to input a film, print, or three-dimensional object. Furthermore, image information recorded in a floppy disk, Zip disk, CR-R, or hard disk can be variously processed on a computer by using Fuji Film Application Software Photo Factory. Fuji Film Digital Color Printer NC-2 or NC-2D using a photo-fixing heat-sensitive color printing system is suited to outputting high-quality prints from a personal computer.

To keep developed APS cartridge films, FUJICOLOR POCKET ALBUM AP-5 POP L, AP-1 POP L, AP-1 POP KG, or CARTRIDGE FILE 16 is preferable.

EXAMPLE 1

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90-μm thick PEN film. Note that proper amounts of blue, magenta, and yellow dyes (I-1, I-4, I-6, I-24, I-26, I-27, and II-5 described in Journal of Technical Disclosure No. 94-6023, the disclosure of which is herein incorporated by reference) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the support were subjected to corona discharge, UV discharge, and glow discharge. After that, each surface of the support was coated with an undercoat solution (10 cc/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-poly (polymerization degree 15) oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15) oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly (polymerization degree 15) oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Light-Sensitive Layers

The surface of the support on the side away from the back layers formed as above was coated with a plurality of layers having the following compositions to manufacture a color negative film.

Compositions of Sensitive Layers

The main materials used in the individual layers are classified as follows. However, the uses of these materials are not restricted to those classified ones.

| | | | |
|---|---|---|---|
| ExC | Cyan coupler | UV | Ultraviolet absorbent |
| ExM | Magenta coupler | HBS | High-boiling organic solvent |
| ExY | Yellow coupler | H | Gelatin hardener |
| ExS | Sensitizing dye | | |

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

Sample 101

| | | |
|---|---|---|
| 1st layer (1st antihalation layer) | | |
| Black colloidal silver | silver | 0.155 |
| Silver bromoiodide emulsion P | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| Silver bromoiodide emulsion O | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver bromoiodide emulsion A | silver | 0.323 |
| ExS-1 | | $5.5 \times 10^{-4}$ |
| ExS-2 | | $1.0 \times 10^{-5}$ |
| ExS-3 | | $2.4 \times 10^{-4}$ |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver bromoiodide emulsion B | silver | 0.28 |
| Silver bromoiodide emulsion C | silver | 0.54 |
| ExS-1 | | $5.0 \times 10^{-4}$ |
| ExS-2 | | $1.0 \times 10^{-5}$ |
| ExS-3 | | $2.0 \times 10^{-4}$ |

-continued

| | | |
|---|---|---|
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver bromoiodide emulsion D | silver | 1.47 |
| ExS-1 | | $3.7 \times 10^{-4}$ |
| ExS-2 | | $1 \times 10^{-5}$ |
| ExS-3 | | $1.8 \times 10^{-4}$ |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Compounds shown in Tables 2, 3, and 4 (coating amounts are described in Tables 2, 3, and 4) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interlayer effect to red-sensitive layer) | | |
| Silver bromoiodide emulsion E | silver | 0.560 |
| ExS-6 | | $1.7 \times 10^{-4}$ |
| ExS-10 | | $4.6 \times 10^{-4}$ |
| Cpd-4 | | 0.030 |
| ExM-2 | | 0.096 |
| ExM-3 | | 0.028 |
| ExY-1 | | 0.031 |
| HBS-1 | | 0.085 |
| HBS-3 | | 0.003 |
| Gelatin | | 0.58 |
| 9th layer (Low-speed green-sensitive emulsion layer) | | |
| Silver bromoiodide emulsion F | silver | 0.39 |
| Silver bromoiodide emulsion G | silver | 0.28 |
| Silver bromoiodide emulsion H | silver | 0.35 |
| ExS-4 | | $2.4 \times 10^{-5}$ |
| ExS-5 | | $1.0 \times 10^{-4}$ |
| ExS-6 | | $3.9 \times 10^{-4}$ |
| ExS-7 | | $7.7 \times 10^{-5}$ |
| ExS-8 | | $3.3 \times 10^{-4}$ |
| ExM-2 | | 0.36 |
| ExM-3 | | 0.045 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver bromoiodide emulsion I | silver | 0.45 |
| ExS-4 | | $5.3 \times 10^{-5}$ |
| ExS-7 | | $1.5 \times 10^{-4}$ |
| ExS-8 | | $6.3 \times 10^{-4}$ |
| ExC-6 | | 0.009 |
| ExM-2 | | 0.031 |
| ExM-3 | | 0.029 |
| ExY-1 | | 0.006 |
| ExM-4 | | 0.028 |
| HBS-1 | | 0.064 |

-continued

| | | |
|---|---|---|
| HBS-3 | | $2.1 \times 10^{-3}$ |
| Gelatin | | 0.44 |
| 11th layer (High-speed green-sensitive emulsion layer) | | |
| Silver bromoiodide emulsion I | silver | 0.19 |
| Silver bromoiodide emulsion J | silver | 0.80 |
| ExS-4 | | $4.1 \times 10^{-5}$ |
| ExS-7 | | $1.1 \times 10^{-4}$ |
| ExS-8 | | $4.9 \times 10^{-4}$ |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-3 | | 0.004 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Solid disperse dye ExF-5 | | 0.020 |
| Solid disperse dye ExF-6 | | 0.020 |
| Oil-soluble dye ExF-7 | | 0.010 |
| HBS-1 | | 0.082 |
| Gelatin | | 1.057 |
| 13th layer (Low-speed blue-sensitive emulsion layer) | | |
| Silver bromoiodide emulsion K | silver | 0.18 |
| Silver bromoiodide emulsion L | silver | 0.20 |
| Silver bromoiodide emulsion M | silver | 0.07 |
| ExS-9 | | $4.4 \times 10^{-4}$ |
| ExS-10 | | $4.0 \times 10^{-4}$ |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver bromoiodide emulsion N | silver | 0.75 |
| ExS-9 | | $3.6 \times 10^{-4}$ |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

-continued

| | | |
|---|---|---|
| 15th layer (1st protective layer) | | |
| Silver bromoiodide emulsion O | silver | 0.30 |
| UV-1 | | 0.21 |
| UV-2 | | 0.13 |
| UV-3 | | 0.20 |
| UV-4 | | 0.025 |
| F-18 | | 0.009 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, iridium salt, ruthenium salt, and rhodium salt. Additionally, a sample was manufactured by adding $8.5\times 10^{-3}$ g and $7.9\times10^{-3}$ g, per mol of a silver halide, of calcium in the form of an aqueous calcium nitrate solution to the coating solutions of the eighth and 11th layers, respectively.

Table 1 below shows the AgI contents, grain sizes, surface iodide contents and the like of emulsions indicated by abbreviations in this example. The surface iodide content can be checked as follows by using XPS. Each sample was cooled to −115° C. in a vacuum of 1×10 torr or less, and MgKα was radiated at an X-ray source voltage of 8 kV and an X-ray current of 20 mA, thereby measuring Ag3d5/2, Br3d, and I3d5/2 electrons. The integral intensity of the measured peak was corrected by a sensitivity factor. From these intensity ratios, the surface iodide content was calculated.

TABLE 1

| Emulsion name | Average iodide content (mol %) | Variation coefficient concerning inter-grain iodide distribution | Average grain size (equivalent-sphere diameter; μm) | Variation coefficient (%) of equivalent-sphere diameter |
|---|---|---|---|---|
| Emulsion A | 3.9 | 20 | 0.37 | 19 |
| B | 5.1 | 17 | 0.52 | 21 |
| C | 7.0 | 18 | 0.86 | 22 |
| D | 4.2 | 17 | 1.00 | 18 |
| E | 7.2 | 22 | 0.87 | 22 |
| F | 2.6 | 18 | 0.28 | 19 |

TABLE 1-continued

| | | | | |
|---|---|---|---|---|
| G | 4.0 | 17 | 0.43 | 19 |
| H | 5.3 | 18 | 0.52 | 17 |
| I | 5.5 | 16 | 0.73 | 15 |
| J | 7.2 | 19 | 0.93 | 18 |
| K | 1.7 | 18 | 0.40 | 16 |
| L | 8.7 | 22 | 0.64 | 18 |
| M | 7.0 | 20 | 0.51 | 19 |
| N | 6.5 | 22 | 1.07 | 24 |
| O | 1.0 | — | 0.07 | — |
| P | 0.9 | — | 0.07 | — |

| Emulsion name | Projected surface diameter (equivalent-circle diameter; μm) | Diameter/thickness ratio | Surface iodide content (mol %) | Grain shape |
|---|---|---|---|---|
| Emulsion A | 0.40 | 2.7 | 2.3 | Tabular grain |
| B | 0.67 | 5.2 | 3.5 | Tabular grain |
| C | 1.27 | 5.9 | 5.2 | Tabular grain |
| D | 1.53 | 6.5 | 2.8 | Tabular grain |
| E | 1.27 | 5.7 | 5.3 | Tabular grain |
| F | 0.28 | 1.3 | 1.7 | Tabular grain |
| G | 0.58 | 3.3 | 2.3 | Tabular grain |
| H | 0.79 | 6.5 | 4.7 | Tabular grain |
| I | 1.03 | 5.5 | 3.1 | Tabular grain |
| J | 1.45 | 5.5 | 5.4 | Tabular grain |
| K | 0.52 | 6.0 | 2.1 | Tabular grain |
| L | 0.86 | 6.3 | 5.8 | Tabular grain |
| M | 0.82 | 5.0 | 4.9 | Tabular grain |
| N | 1.52 | 7.3 | 3.2 | Tabular grain |
| O | 0.07 | 1.0 | — | Uniform structure |
| P | 0.07 | 1.0 | — | Uniform structure |

In Table 1, (1) The emulsions L to O were subjected to reduction sensitization during grain preparation by using thiourea dioxide and thiosulfonic acid in accordance with examples in JP-A-2-191938, the disclosure of which is herein incorporated by reference.

(2) The emulsions A to O were subjected to gold sensitization, sulfur sensitization, and selenium sensitization in the presence of the spectral sensitizing dyes described in the individual sensitive layers and sodium thiocyanate in accordance with examples in JP-A-3-237450, the disclosure of which is herein incorporated by reference.

(3) The tabular grains were prepared by using low-molecular weight gelatin in accordance with examples in JP-A-1-158426, the disclosure of which is herein incorporated by reference.

(4) Dislocation lines as described in JP-A-3-237450, the disclosure of which is herein incorporated by reference were observed in the tabular grains when a high-voltage electron microscope was used.

Preparation of Dispersions of Organic Solid Disperse Dyes

ExF-2 was dispersed by the following method. That is, 21.7 milliliters (milliliter will be referred to as "mL" hereinafter) of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549,489A, the disclosure of which is herein incorporated by reference. The average grain size was found to be 0.06 μm.

Compounds used in the formation of the individual layers in this example were as follows.

ExC-1
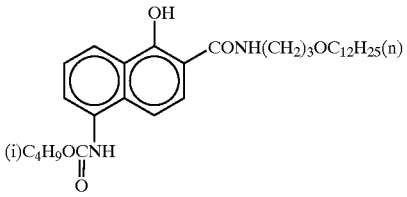
ExC-2
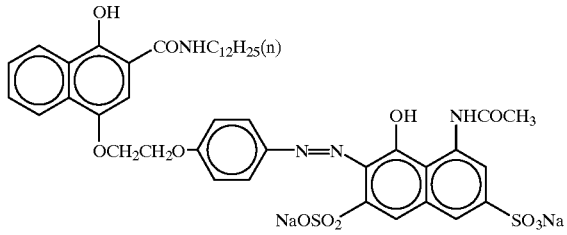
ExC-3
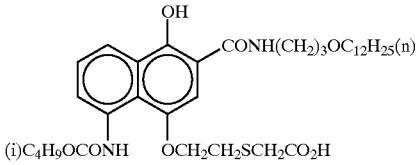
ExC-4
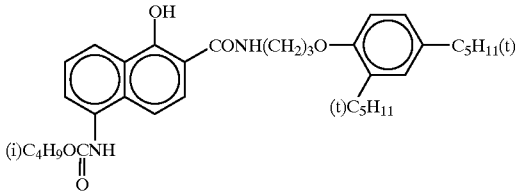
ExC-5
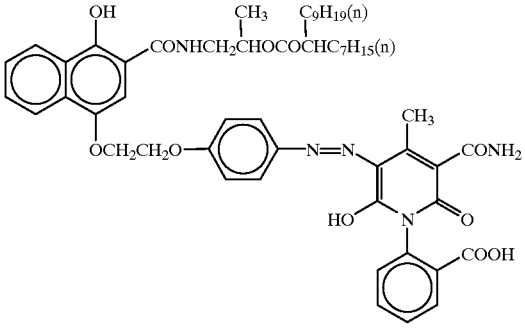
ExC-6
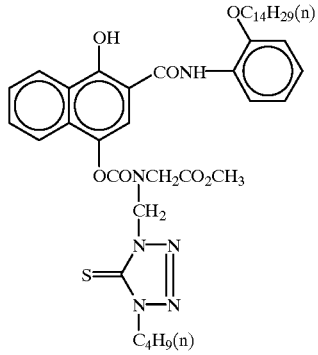
ExC-7
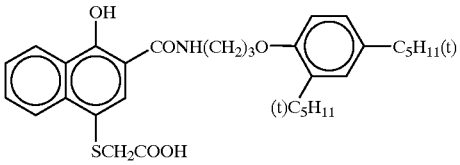
ExC-8
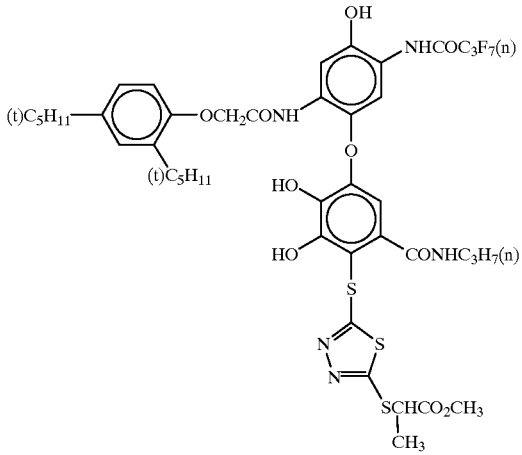

-continued
ExM-1
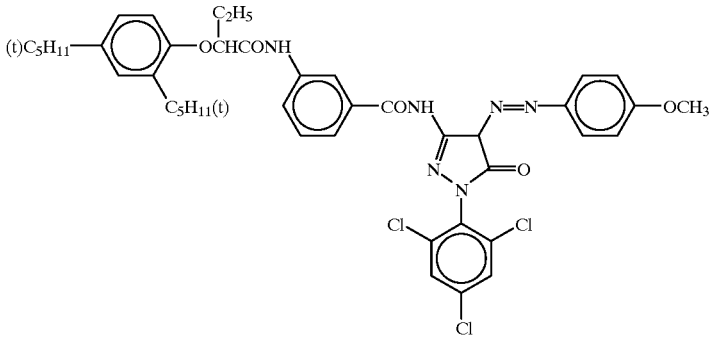
ExM-2
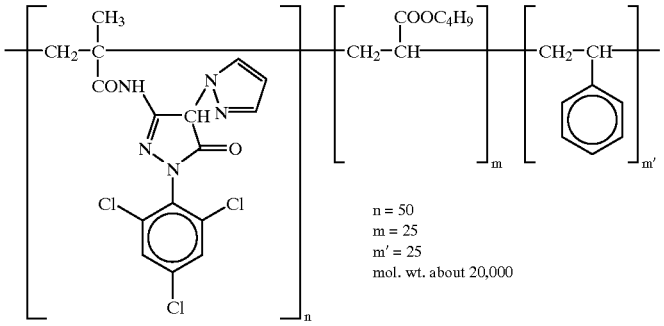
n = 50
m = 25
m′ = 25
mol. wt. about 20,000
ExM-3
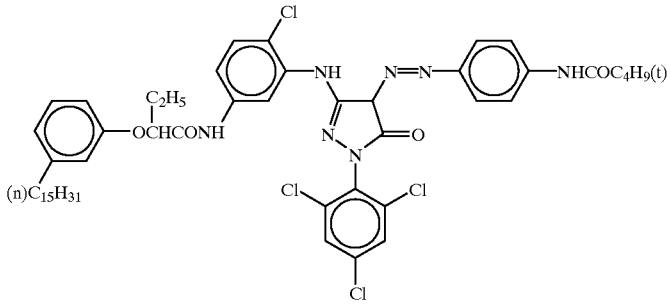
ExM-4
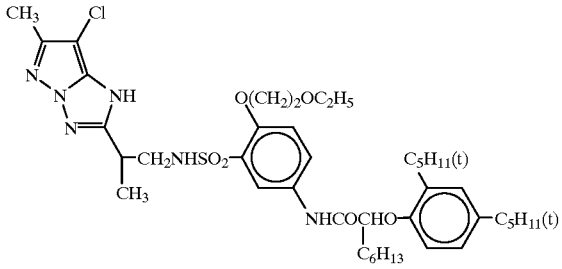
ExM-5
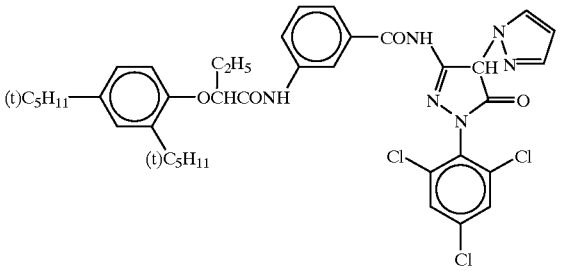
ExY-1
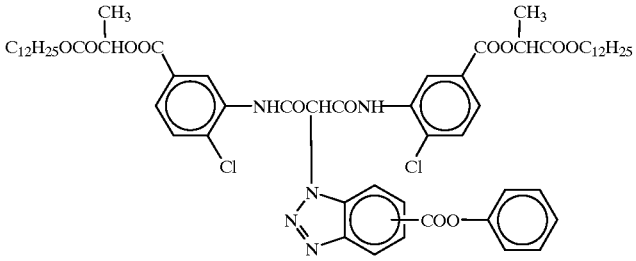

-continued
ExY-2
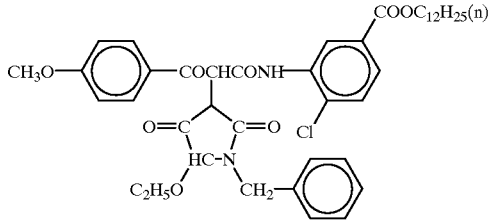
ExY-3
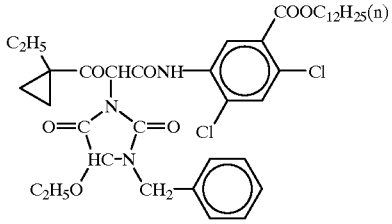
ExY-4
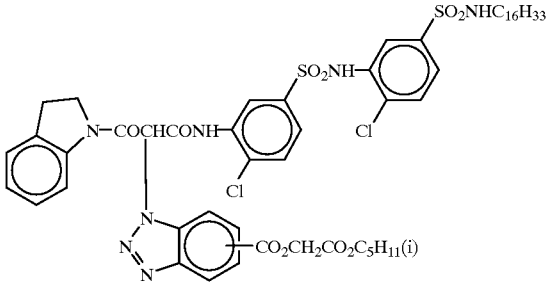
ExY-5
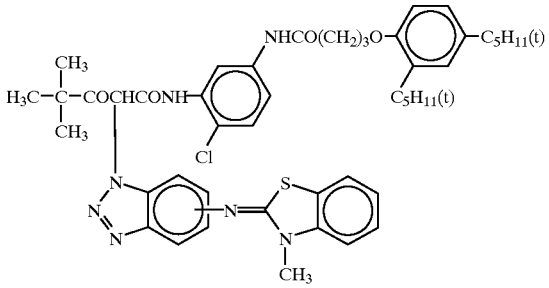
ExY-6
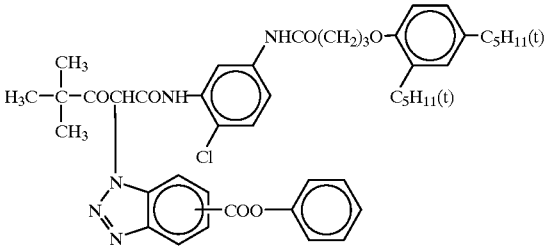
ExF-1
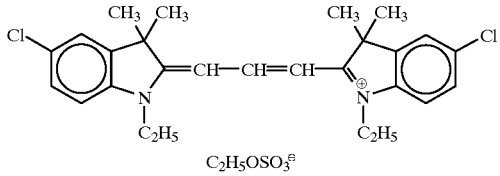
ExF-2
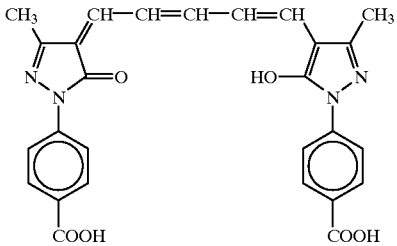
ExF-3
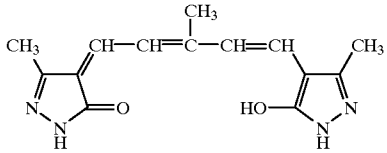
ExF-4
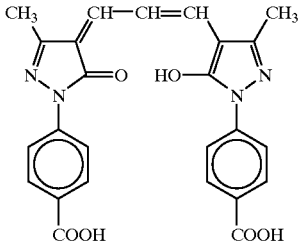
ExF-5
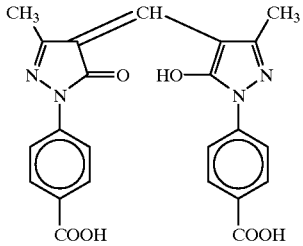
ExF-6
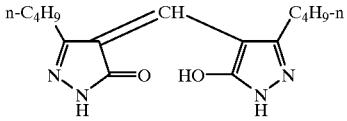
ExF-7
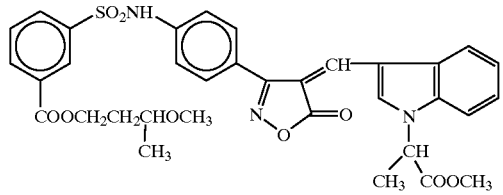

-continued
Cpd-1
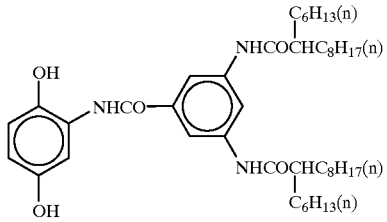
Cpd-2
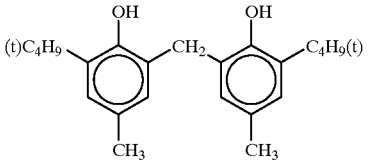
Cpd-3
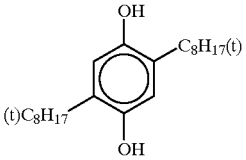
Cpd-4
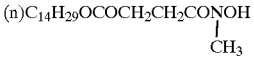
UV-1
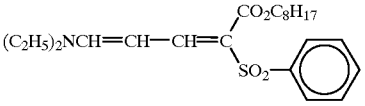
UV-2
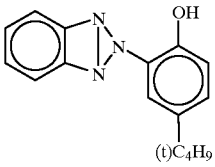
UV-3
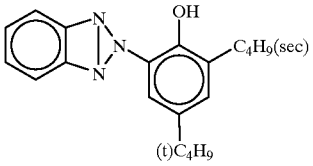
UV-4
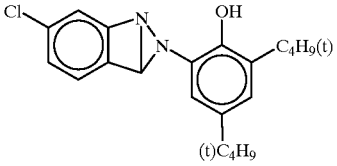
HBS-1
tricresyl phosphate
HBS-2
di-n-butylphthalate
HBS-3
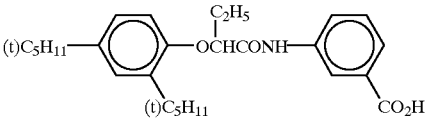
HBS-4
tri(2-ethylhexyl)phosphate
ExS-1
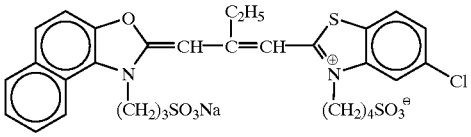
ExS-2
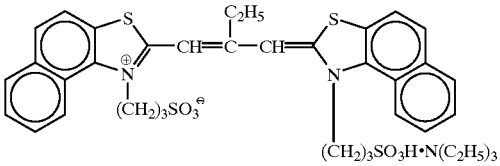
ExS-3
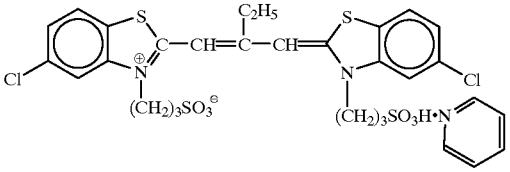
ExS-4
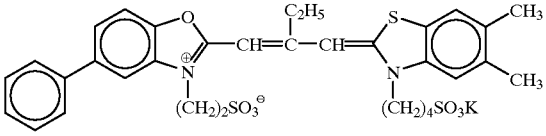
ExS-5
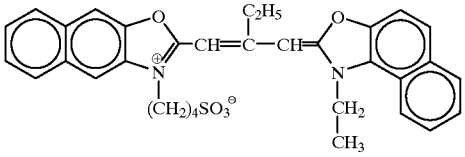
ExS-6
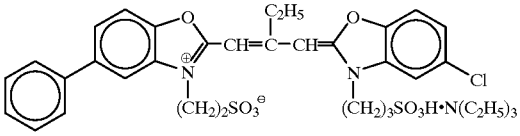

-continued
ExS-7
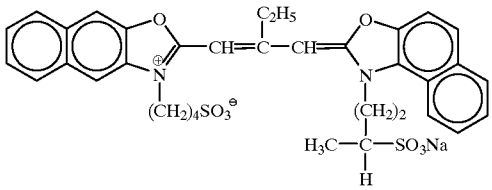
ExS-8
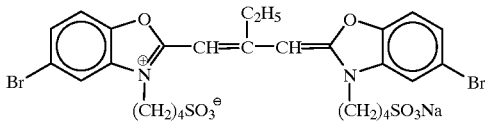
ExS-9
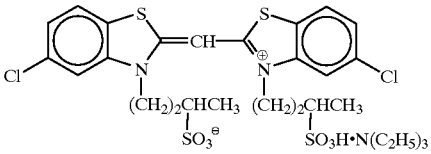
ExS-10
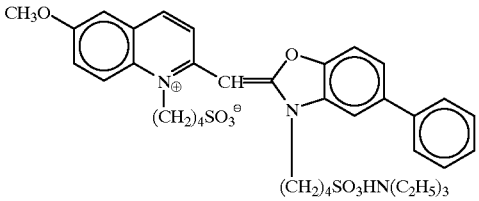
S-1
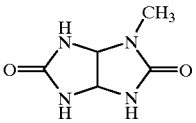
H-1
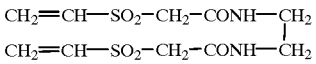
B-1
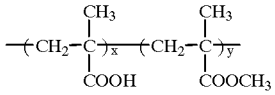
x/y = 10/90 (weight ratio)
average molecular weight:
about 35,000
B-2
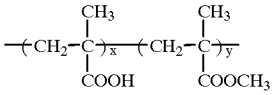
x/y = 40/60 (weight ratio)
average molecular weight:
about 20,000
B-3
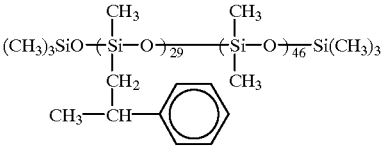
(mole ratio)
average molecular weight:
about 8,000
B-4
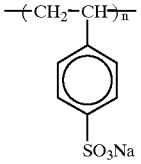
average molecular weight:
about 750,000
B-5
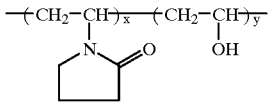
x/y = 70/30 (weight ratio)
average molecular weight:
about 17,000
B-6
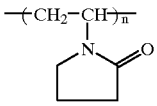
average molecular weight:
about 10,000
W-1
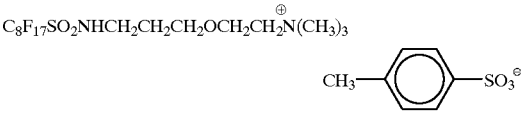
W-2
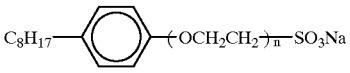
n=2~4
W-3
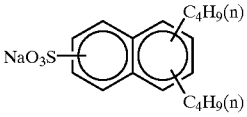
W-4
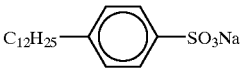
W-5
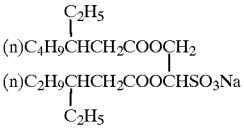
F-1
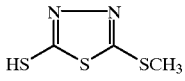

-continued

F-2

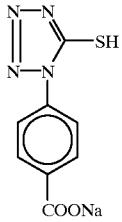

F-3

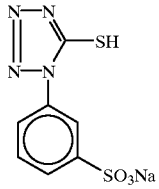

F-4

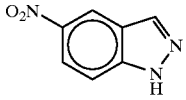

F-5

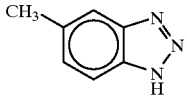

F-6

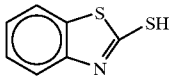

F-7

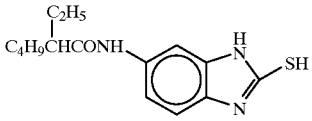

F-8

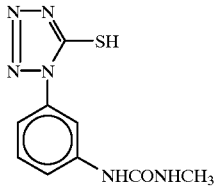

F-9

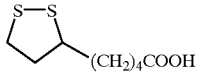

F-10

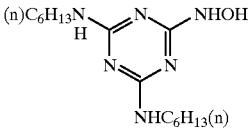

F-11

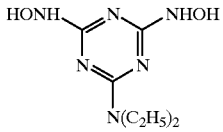

F-12

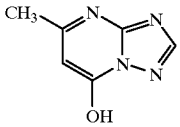

F-13

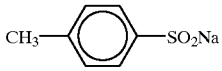

F-14

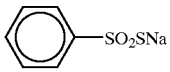

F-15

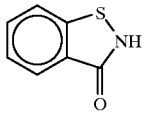

F-16

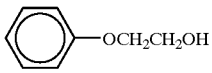

F-17

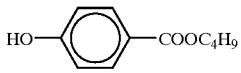

F-18

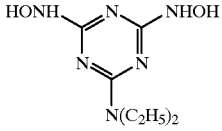

Each sample formed as above was cut into a 24-mm wide, 160-cm long photosensitive material. Two square perforations of 2 mm side were formed at an interval of 5.8 mm in a position 0.7 mm from one side along the longitudinal direction of the photosensitive material. These two sets were formed at an interval of 32 mm and housed in a plastic film cartridge explained in FIGS. 1 to 7 of U.S. Pat. No. 5,296,887, the disclosure of which is herein incorporated by reference.

Digital saturation recording was performed for this sample, from the side on which the magnetic recording layer was formed, at a feed velocity of 100 mm/sec and a recording wavelength of 50 $\mu$m by using a permalloy audio type magnetic recording head having a head gap of 5 $\mu$m and the number of turns of 50.

The above sample was given gray exposure of 5 cms at a color temperature of 4,800 K and subjected to the following development by using a processing machine for motion picture film. In addition, the photosensitive material was subjected to the running process for five days in units of $2m^2$ a day. The processed photosensitive material was again housed in the plastic film cartridge.

Processing Steps

| Step | Time | Temperature | Replenishment rate | Tank volume |
|---|---|---|---|---|
| Color development | 3 min 5 sec | 38.0° C. | 390 mL/$m^2$ | 17L |
| Bleaching | 50 sec | 38.0° C. | 130 mL/$m^2$ | 5L |
| Fixing (1) | 50 sec | 38.0° C. | — | 5L |
| Fixing (2) | 50 sec | 38.0° C. | 260 mL/$m^2$ | 5L |
| Washing | 30 sec | 38.0° C. | 500 mL/$m^2$ | 3.5L |
| Stabilization (1) | 20 sec | 38.0° C. | — | 3L |
| Stabilization (2) | 20 sec | 38.0° C. | 500 mL/$m^2$ | 3L |
| Drying | 90 sec | 60° C. | | |

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 65 mL, 50 mL, and 50 mL, respectively, per $m^2$ of a 35-mm wide photosensitive material. Note also that each crossover time was 6 sec, and this time was included in the processing time of each preceding step.

The compositions of the processing solutions are presented below.

| (Color developer) | Tank solution (g) | Replenisher (g) |
|---|---|---|
| Diethylenetriamine pentaacetic acid | 3.0 | 3.0 |
| Tiron | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 10.0 | 13.0 |
| Potassium bromide | 1.25 | 0.4 |
| Potassium iodide | 1.3 mg | — |
| 4-hydroxy-6-methyl-1,3,3a,7-tetrazaindene | 0.05 | — |
| 2-methyl-4-[N-ethyl-N-(β-hydroxyethyl)amino] aniline sulfate | 4.5 | 6.5 |
| Water to make | 1.0L | 1.0L |
| pH (controlled by potassium hydroxide and sulfuric acid) | 10.05 | 10.18 |

| (Bleaching solution) | Tank solution (g) | Replenisher (g) |
|---|---|---|
| Ferric ammonium 1,3-diaminopropanetetra acetate monohydrate | 113.0 | 170.0 |
| Ammonium bromide | 70.0 | 105.0 |
| Ammonium nitrate | 14.0 | 21.0 |
| Succinic acid | 34.0 | 51.0 |
| Maleic acid | 28.0 | 42.0 |
| Water to make | 1,000 mL | 1,000 mL |
| pH (controlled by ammonia water and nitric acid) | 4.6 | 4.0 |

-continued

Fixing (1) Tank Solution

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240.0 mL | 720.0 mL |
| Ammonium methane thiosulfonate | 5.0 | 15.0 |
| Ammonium methane sulfinate | 10.0 | 30.0 |
| Ethylenediamine tetraacetic acid | 13.0 | 39.0 |
| Imidazole | 7.0 | 21.0 |
| Water to make | 1,000 mL | 1,000 mL |
| pH (controlled by ammonia water and acetic acid) | 7.4 | 7.5 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L, or less. Subsequently, 20 mg/L of sodium isocyanuric acid dichloride and 150 mg/L of sodium sulfate were added. The pH of the solution ranged from 6.5 to 7.5.

(Stabilizer) Common to Tank Solution and Replenisher

| | |
|---|---|
| 1,4-bis(1,2,4-triazole-1-isomethyl) piperazine | 0.75 g |
| 1,2,4-triazole | 1.3 g |
| Polyoxyethylene-p-monononylphenylether (average polymerization degree 10) | 0.2 g |
| Disodium ethylenediaminetetraacetate | 0.05 g |
| Sodium p-toluenesulfinate | 0.03 g |
| 1,2-benzoisothiazoline-3-one.sodium | 0.10 g |
| Gentamicin | 0.01 g |
| Water to make | 1L |
| pH (controlled by ammonia water and nitric acid) | 8.5 |

To evaluate the storage stability, the following storage stability evaluation experiment was conducted without running process.

An unexposed sample was stored for four weeks at a relative humidity of 40% and 50° C. This sample and an identical sample stored for four weeks at 5° C. were given sensitometry exposure for 1/100 sec at a color temperature of 4,800 K through a continuous wedge, and the abovementioned color development was performed. Subsequently, density measurements were performed, and the difference (Δfog1) between the fog value of the sample stored at 50° C. and the sample stored at 5° C. was calculated.

Also, a sample stored for four weeks at a relative humidity of 80% and 50° C. and a sample stored for four weeks at 5° C. were similarly processed, and the fog value difference (Δfog2) was calculated. Table 2 shows the results.

A minimum cyan density change before and after the running of development of each photosensitive material processed by the above method was evaluated by the following method.

Measurement of Minimum Density of Cyan

The gradation of a photosensitive material was measured by reading a minimum cyan density change on characteristic curves at the beginning of and after running, and calculating the density difference.

$$(\Delta D\text{min})=(\text{minimum cyan density after running})-(\text{minimum cyan density at the beginning of running})$$

The larger a positive value, the higher the density.

The results are shown in Table 2 together with the storage stability.

5,614,360, respectively. Especially at high humidity, the comparative compounds A, B, C, D, and E could not suppress fog during storage, whereas compounds represented by formulas (I-1) and (I-2) of the present invention exhibited a remarkable storage stability improving effect.

The present inventors checked whether the viscosity of the gelatin solution in the 7th layer before coating changed by the addition of compounds (I)-1, (I)-3, (I)-6, and (I)-6 of the present invention. As a consequence, no viscosity rise was found. On the other hand, when $Na_2PdCl_4$ (a compound described in JP-A-5-333480, the disclosure of which is herein incorporated by reference) was added in an amount equivalent to $6\times10^{-6}$ mol/m$^2$ to the coating solution for the 7th layer, the viscosity abruptly rose to partially form a mass. This made a uniform coating solution impossible to prepare. The coating solution could be formed when the

TABLE 2

| Sample No. | Relation to the application concerned | Compound added to the 7th layer | Addition amount (mol/m$^2$) |
|---|---|---|---|
| 101 | Comparative example | None | 0 |
| 102 | Comparative example | Comparative compound A | $6\times10^{-6}$ |
| 103 | Comparative example | Comparative compound 13 | $6\times10^{-6}$ |
| 104 | Comparative example | Comparative compound C | $6\times10^{-6}$ |
| 105 | Comparative example | Comparative compound D | $6\times10^{-6}$ |
| 106 | Comparative example | Comparative compound E | $6\times10^{-6}$ |
| 107 | Comparative example | $Na_2PdCl_4$ | $2\times10^{-6}$ |
| 108 | Present invention | (I)-1 | $6\times10^{-6}$ |
| 109 | Present invention | (I)-2 | $6\times10^{-6}$ |
| 110 | Present invention | (I)-3 | $6\times10^{-6}$ |
| 111 | Present invention | (I)-4 | $6\times10^{-6}$ |
| 112 | Present invention | (I)-5 | $6\times10^{-6}$ |
| 113 | Present invention | (I)-6 | $6\times10^{-6}$ |
| 114 | Present invention | (I)-7 | $6\times10^{-6}$ |
| 115 | Present invention | (I)-9 | $6\times10^{-6}$ |
| 116 | Present invention | (I)-10 | $6\times10^{-6}$ |
| 117 | Present invention | (I)-16 | $6\times10^{-6}$ |
| 118 | Present invention | (I)-17 | $6\times10^{-6}$ |
| 119 | Present invention | (I)-18 | $6\times10^{-6}$ |
| 120 | Present invention | (I)-19 | $6\times10^{-6}$ |

| Sample No. | Δ fog1 (cyan) (increase in storage fog at a relative humidity of 50% and 50° C.) | Δ fog2 (cyan) (increase in storage fog at a relative humidity of 80% and 50° C.) | Δ Dmin (change in minimum cyan density before and after running |
|---|---|---|---|
| 101 | 0.22 | 0.27 | 0.01 |
| 102 | 0.19 | 0.27 | 0.11 |
| 103 | 0.19 | 0.27 | 0.11 |
| 104 | 0.20 | 0.28 | 0.14 |
| 105 | 0.19 | 0.27 | 0.12 |
| 106 | 0.19 | 0.28 | 0.13 |
| 107 | 0.19 | 0.25 | 0.01 |
| 108 | 0.12 | 0.14 | 0.01 |
| 109 | 0.12 | 0.14 | 0.00 |
| 110 | 0.12 | 0.14 | 0.01 |
| 111 | 0.14 | 0.16 | 0.01 |
| 112 | 0.12 | 0.15 | −0.01 |
| 113 | 0.i3 | 0.14 | 0.01 |
| 114 | 0.14 | 0.16 | 0.00 |
| 115 | 0.15 | 0.17 | 0.01 |
| 116 | 0.15 | 0.17 | 0.00 |
| 117 | 0.14 | 0.16 | 0.02 |
| 118 | 0.16 | 0.20 | 0.01 |
| 119 | 0.16 | 0.21 | 0.01 |
| 120 | 0.16 | 0.20 | 0.00 |

Table 2 reveals the following for the storage stability.

The storage fog with time can be suppressed when compounds re presented by formulas (I-1) and (I-2) of the pre sent invention are used (samples 101 and 108 to 120).

This effect by far exceeds the storage stability improving effects (samples 102 to 106) of comparative compounds A, B, C, D, and E, which correspond to the exemplified compounds p-1, p-3, p-4, p-5 and p-6 of U.S. Pat. No.

addition amount of this $Na_2PdCl_4$ was $2\times10^{-6}$ mol/m$^2$. However, an effect of suppressing storage fog was insignificant (sample 107), so it was impossible to suppress the viscosity rise and improve the storage stability at the same time.

The structures of the comparative compounds A to E (compounds described in JP-A-8-234341, the disclosure of which is herein incorporated by reference) in Table 2 are presented below.

Comparative compound A

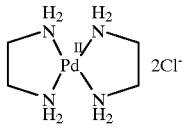

Comparative compound B

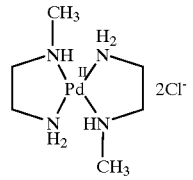

Comparative compound C

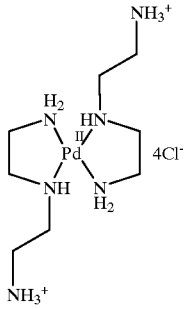

Comparative compound D

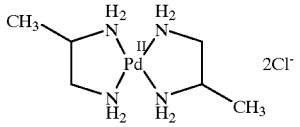

Comparative compound E

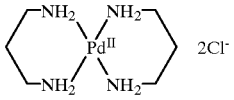

Table 2 reveals the following for the minimum cyan density change before and after the running of development.

When compounds represented by formulas (I-1) and (I-2) of the present invention are used, the minimum cyan density does not increase after the running of development (samples 101 and 108 to 120).

On the other hand, when the conventionally known comparative compounds A to E were used, the minimum cyan density after the running increased (samples 102 to 106).

A similar effect can be obtained when the compounds shown in Table 2 are added to the 15th layer, instead of the 7th layer.

EXAMPLE 2

Samples 201, 202, and 203 were formed following the same procedures as in Example 1 except that the silver bromoiodide emulsion D in the 6th layer of the photosensitive material of Example 1 was changed to emulsions Em-1A, Em-2A, and Em-3A.

Manufacturing Method of Em-1 (Average Aspect Ratio 5.5)

1,200 mL of an aqueous solution containing 1.0 g of low-molecular-weight gelatin having a molecular weight of 15,000 and 1.0 g of KBr was held at 35° C. and vigorously stirred. 30 mL of an aqueous solution containing 1.9 g of $AgNO_3$ and 30 mL of an aqueous solution containing 1.5 g of KBr and 0.7 g of low-molecular-weight gelatin having a molecular weight of 15,000 were added over 30 sec by the double jet method to perform nucleation. During the nucleation, the excess density of KBr was held constant. 50 g of KBr were added, and the temperature was raised to 75° C. to ripen the resultant material. After the ripening, 35 g of phthalated gelatin containing 35 $\mu$mol of methionine per 1 g and having a molecular weight of 100,000 and a phthalation ratio of 97% were added. The pH was adjusted to 5.6. 150 mL of an aqueous solution containing 30 g of $AgNO_3$ and an aqueous KBr solution were added over 16 min by the double jet method (growth step 1). During the addition, the silver potential was held at 0 mV with respect to a saturated calomel electrode. In addition, an aqueous solution containing 110 g of $AgNO_3$ and an aqueous KBr solution (15 wt %) containing 3.8 mol % of KBr were added over 15 min by the double jet method while the flow rate was accelerated so that the final flow rate was 1.2 times the initial flow rate (growth step 2). During the addition, the silver potential was held at 0 mV. Furthermore, 132 mL of an aqueous solution containing 35 g of $AgNO_3$ and an aqueous KBr solution were added over 7 min by the double jet method. The addition of the aqueous KBr solution was so adjusted that the potential at the end of the addition was +20 mV. After 2 mg of sodium benzenethiosulfonate were added, KBr was added to adjust the silver potential to −20 mV. 100 mL of an aqueous solution containing 6.8 g of $AgNO_3$ and 900 mL of an aqueous solution containing 7.1 g of KI were added over 10 min by the double jet method. Immediately after the addition, 250 mL of an aqueous solution containing 70 g of $AgNO_3$ and 170 mL of an aqueous solution containing 50 g of KBr were added over 20 min. After washing with water, 45 g of gelatin were added, and the pH and the pAg were adjusted to 5.8 and 8.7, respectively, at 40° C.

Preparation of Em-2 (Average Aspect Ratio 9.0)

Em-2 was prepared following the same procedures as for Em-1 except that the silver potentials in the growth steps 1 and 2 were changed to −20 mV.

Preparation of Em-3 (Average Aspect Ratio 16)

1,200 mL of an aqueous solution containing 1.0 g of low-molecular-weight gelatin having a molecular weight of 15,000 and 1.0 g of KBr was held at 35° C. and vigorously stirred. 30 mL of an aqueous solution containing 1.9 g of $AgNO_3$ and 30 mL of an aqueous solution containing 1.5 g of KBr and 0.7 g of low-molecular-weight gelatin having a molecular weight of 15,000 were added over 30 sec by the double jet method to perform nucleation. During the nucleation, the excess density of KBr was held constant. 50 g of KBr were added, and the temperature was raised to 75° C. to ripen the resultant material. After the ripening, 15 g of trimellitated gelatin containing 35 $\mu$mol of methionine per 1 g and having a molecular weight of 100,000 and a trimellitation ratio of 98%, 10 g of phthalated gelatin, and 10 g of oxidized gelatin were added. The pH was adjusted to 5.6. 150 mL of an aqueous solution containing 30 g of $AgNO_3$ and an aqueous KBr solution were added over 16 min by the double jet method. During the addition, the silver potential was held at −30 mV with respect to a saturated calomel electrode. In addition, an aqueous solution containing 110 g of $AgNO_3$ and an aqueous KBr solution were added over 15 min by the double jet method while the flow rate was accelerated so that the final flow rate was 1.2 times the initial flow rate. During the addition, the aforementioned AgI fine grain emulsion was simultaneously added at an accelerated flow rate so that the silver iodide content was 3.8%, and the silver potential was held at −30 mV. 132 mL of an aqueous solution containing 35 g of $AgNO_3$ and an aqueous KBr solution were added over 7 min by the double jet method. The addition of the aqueous KBr solution was so adjusted that the potential at the end of the addition was −20 mV. After the temperature was decreased to 40° C., sodium p-iodoacetamidobenzenesulfonate (compound 1) was added in an amount of 7.1 g as a KI content, and 64 cc of an aqueous 0.8M sodium sulfite solution were added. Furthermore, an aqueous NaOH solution was added to raise the pH to 9.0 and hold at that value for 4 min, thereby abruptly producing iodide ions. After that, the pH was returned to 5.5. The temperature was returned to 75° C., 2 mg of sodium benzenethiosulfonate were added, and 13 g of gelatin were added. After the addition, 250 mL of an aqueous solution containing 70 g of $AgNO_3$ and an aqueous KBr solution were added over 20 min while the potential was held at 0 mV. After washing with water, 45 g of gelatin were added, and the pH and the pAg were adjusted to 5.8 and 8.7, respectively, at 40° C., thereby forming Em-3.

Chemical Sensitization and Spectral Sensitization

Preparation of Fine Solid Dispersions of Sensitizing Dyes

Fine solid dispersions of sensitizing dyes 1 to 3 were prepared as follows. Under the preparation conditions shown in Table 3, inorganic salt was dissolved in ion exchange water, and the sensitizing dyes were added. The resultant solutions were dispersed at 60° C. for 20 min by using a dissolver blade at 2,000 rpm to form fine solid dispersions of the sensitizing dyes 1 to 3.

TABLE 3

| Sensitizing dyes | Sensitizing dye amounts | $NaNO_3/Na_2SO_4$ | Water | Dispersion time | Dispersion temperature |
|---|---|---|---|---|---|
| 1 | 3 wt % | 0.8 wt %/3.2 wt % | 43 wt % | 20 min. | 60° C. |
| 2 and 3 | 4 wt % of sensitizinq dye 2<br>0.12 wt % of sensitizing dye 3 | 0.6 wt %/2.4 wt % | 42.8 wt % | 20 min. | 60° C. |

Sensitizing dye 1

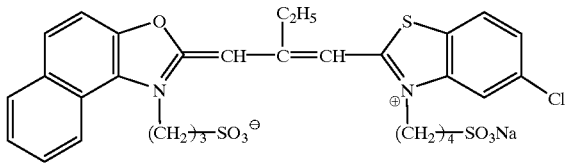

Sensitizing dye 2

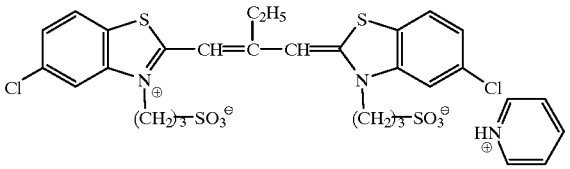

-continued

Sensitizing dye 3

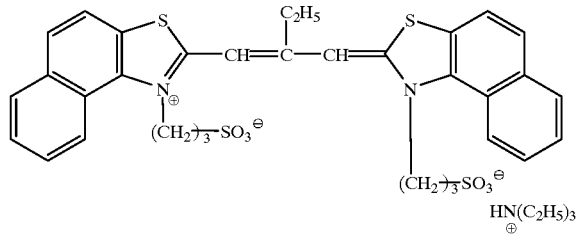

Preparation of Em-1A, Em-2A, and Em-3A

Em-1, Em-2, or Em-3 was heated to 56° C. The sensitizing dyes 1, 2, and 3 were added at a molar ratio of 58:36:1 in the form of fine solid dispersions. After that, potassium thiocyanate, chloroauric acid, sodium thiosulfate, and N,N-dimethylselenourea were added to optimally chemically sensitize the fine solid dispersions. After the chemical sensitization was completed, a compound F-2 was added to prepare Em-1A, Em-2A, and Em-3A.

The storage stability was evaluated following the same procedures as in Example 1 except that the aging period was three weeks. The results are shown in Table 4 below.

TABLE 4

| Sample No. | 6th layer emulsion | Ratio of grains having an aspect ratio of 8 or more | Averge aspect ratio | Pd compound added to the 7th layer | Pd compound addition amount ($mol/m^2$) |
|---|---|---|---|---|---|
| 201 | Em-1A | 40 | 5.5 | None | 0 |
| 201 | Em-1A | 40 | 5.5 | Comparative compound A | $6 \times 10^{-6}$ |
| 201 | Em-1A | 40 | 5.5 | (I)-2 | $6 \times 10^{-6}$ |
| 202 | Em-2A | 61 | 9.0 | None | 0 |
| 202 | Em-2A | 61 | 9.0 | Comparative compound A | $6 \times 10^{-6}$ |
| 202 | Em-2A | 61 | 9.0 | (I)-2 | $6 \times 10^{-6}$ |
| 203 | Em-3A | 90 | 16 | None | 0 |
| 203 | Em-3A | 90 | 16 | Comparative compound A | $6 \times 10^{-6}$ |
| 203 | Em-3A | 90 | 16 | (I)-2 | $6 \times 10^{-6}$ |

Δ fog2 (cyan)

TABLE 4-continued

| Sample No. | Relation to the application concerned | Relative sensitivity* | (increase in storage fog at a relative humidity of 80% and 50° C.) | Δ Dmin (change in minimum cyan density before and after running) |
|---|---|---|---|---|
| 201 | Comparative example | 100 | 0.19 | 0.01 |
| 201 | Comparative example | 100 | 0.19 | 0.12 |
| 201 | Present invention | 100 | 0.14 | 0.01 |
| 202 | Comparative example | 140 | 0.27 | 0.01 |
| 202 | Comparative example | 139 | 0.28 | 0.18 |
| 202 | Present invention | 140 | 0.15 | 0.01 |
| 203 | Comparative example | 170 | 0.32 | 0.02 |
| 203 | Comparative example | 170 | 0.33 | 0.21 |
| 203 | Present invention | 171 | 0.16 | 0.01 |

*Processed in the initial stages of running.

It is evident from Table 4 that as the ratio of grains having an aspect ratio of 8 or more in the 6th layer emulsion increases from 40% to 61% and to 90% (as the average aspect ratio increases from 5.5 to 9.0 and to 16), the storage stability improving effect of compounds of the present invention increases.

Furthermore, the effect of suppressing an increase in the minimum cyan density before and after running also increases as the ratio of grains having an aspect ratio of 8 or more in the 6th layer emulsion increases from 40% to 61% and to 90%.

EXAMPLE 3

Effects similar to those of Example 1 of the application concerned were obtained even when color reversal processing described in Example 1 of JP-A-9-5912 was performed using a sample formed by adding the compounds shown in Table 2 to the 7th layer (interlayer) of a sample 201 described in Example 2 of JP-A-9-5912.

EXAMPLE 4

Effects similar to those of Example 1 of the application concerned were obtained even when development described in Example 1 of JP-A-8-240877, which is the Patent Application corresponding to U.S. Pat. No. 5,700,630, was performed using a sample formed by adding the compounds shown in Table 2 to an interlayer of a photographic material 9 as an X-ray photosensitive material described in Example 1 of JP-A-8-240877.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic light-sensitive material comprising at least one photosensitive silver halide emulsion layer on a support, and containing a Pd(II) complex represent ed by formula (I-1):

Formula (I-1)

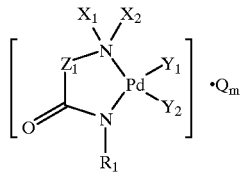

where $Z_1$ represents an alkylene group, an arylene group, or a divalent heterocyclic group, Q represents an ion which neutralizes electric charge of the Pd complex, m represents an integer of from 0 to 4, $R_1$ represents a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group, each of $X_1$ and $X_2$ represents a hydrogen atom, an alkyl group, an aryl group, or a heterocyclic group, and each of $Y_1$ and $Y_2$ represents an organic or inorganic ligand wherein $Y_1$ and $Y_2$ may be combined to form a ring together with Pd.

2. The material according to claim 1, where said Pd(II) complex is represented by formula (I-2):

Formula (I-2)

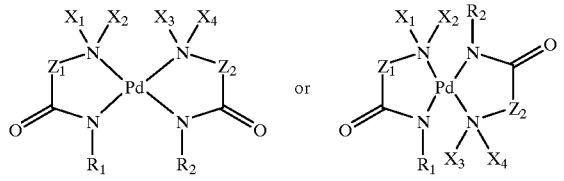

where each of $Z_1$ and $Z_2$ represents an alkylene group, an arylene group, or a divalent heterocyclic group, each of $R_1$ and $R_2$ represents a hydrogen atom, an alkyl group, an aryl group, a heterocyclic group, an acyl group, an alkoxycarbonyl group, an aryloxycarbonyl group, a carbamoyl group, an alkylsulfonyl group, or an arylsulfonyl group, and each of $X_1$, $X_2$, $X_3$, and $X_4$ represents a hydrogen atom, an alkyl group, an aryl group, or a heterocyclic group.

3. The material according to claim 1, comprising at least one blue-sensitive emulsion layer, at least one green-sensitive layer, at least one red-sensitive layer, and at least one non-light-sensitive layer.

4. The material according to claim 2, comprising at least one blue-sensitive emulsion layer, at least one green-sensitive layer, at least one red-sensitive layer, and at least one non-light-sensitive layer.

5. The material according to claim 3, where not less than 60% of a total projected area of silver halide grains contained in said photosensitive silver halide emulsion layer is occupied by tabular silver halide grains having an aspect ratio of not less than 8.

6. The material according to claim 4, where not less than 60% of a total projected area of silver halide grains contained in said photosensitive silver halide emulsion layer is occupied by tabular silver halide grains having an aspect ratio of not less than 8.

* * * * *